US009208789B2

(12) United States Patent
Schug et al.

(10) Patent No.: US 9,208,789 B2
(45) Date of Patent: Dec. 8, 2015

(54) REDUCED COMPLEXITY CONVERTER SNR CALCULATION

(71) Applicants: Dolby Laboratories Licensing Corporation, San Francisco, CA (US); Dolby International AB, Amsterdam Zuidoost (NL)

(72) Inventors: Michael Schug, Erlangen (DE); Phillip Williams, Alameda, CA (US); Luca Baradel, San Francisco, CA (US)

(73) Assignees: Dolby Laboratories Licensing Corporation, San Francisco, CA (US); Dolby International AB, Amsterdam Zuidoost (NL)

( * ) Notice: Subject to any disclaimer, the term of this patent is extended or adjusted under 35 U.S.C. 154(b) by 61 days.

(21) Appl. No.: 14/184,961

(22) Filed: Feb. 20, 2014

(65) Prior Publication Data

US 2014/0188488 A1 Jul. 3, 2014

Related U.S. Application Data

(63) Continuation-in-part of application No. PCT/EP2013/072961, filed on Nov. 4, 2013.

(60) Provisional application No. 61/723,687, filed on Nov. 7, 2012.

(51) Int. Cl.
*G10L 19/02* (2013.01)
*G10L 19/008* (2013.01)
(Continued)

(52) U.S. Cl.
CPC ..... *G10L 19/008* (2013.01); *G10L 19/02* (2013.01); *G10L 19/032* (2013.01); *G10L 19/173* (2013.01)

(58) Field of Classification Search
CPC ..... G10L 19/02
USPC ..... 704/200–201, 500–504
See application file for complete search history.

(56) References Cited

U.S. PATENT DOCUMENTS 5,970,461 A * 10/1999 Chatterton ..... 704/500
6,430,529 B1 * 8/2002 Huang ..... 704/229
(Continued)

FOREIGN PATENT DOCUMENTS

CN 101425293 5/2009
EP 1228506 8/2002
(Continued)

OTHER PUBLICATIONS

Zhang, T et al. "An Efficient Bit Allocation Strategy in AC-3 Encoder" 2010 International Conference on Measuring Technology and Mechatronics Automation, vol. 1, Mar. 13-14, 2010, pp. 457-460.
(Continued)

*Primary Examiner* — Douglas Godbold

(57) ABSTRACT

An audio encoder configured to encode an audio signal to generate a bitstream having E-AC-3 format, including by determining a first control parameter indicative of an allocation of available mantissa bits for quantized audio content of the signal. The encoder is configured to perform transcoding simulation to determine a second control parameter in a manner based at least in part on statistical analysis of results of E-AC-3 bit allocation processing of audio data assuming a first target data rate, and of AC-3 bit allocation processing of the data assuming a second target data rate, and to include the second control parameter in the bitstream for use by a converter to convert the bitstream into a second bitstream having AC-3 format at the second target data rate. Other aspects are converters configured to perform transcoding on a bitstream using such a second control parameter, and methods performed by any embodiment of the inventive encoder or converter.

27 Claims, 18 Drawing Sheets

(51) Int. Cl.
*G10L 19/032* (2013.01)
*G10L 19/16* (2013.01)

(56) References Cited

U.S. PATENT DOCUMENTS

| | | | | |
|---|---|---|---|---|
| 2004/0165667 | A1* | 8/2004 | Lennon et al. | 375/242 |
| 2009/0067644 | A1* | 3/2009 | Crockett et al. | 381/98 |
| 2009/0240507 | A1* | 9/2009 | Jax et al. | 704/500 |
| 2010/0268542 | A1 | 10/2010 | Kim | |
| 2011/0028215 | A1* | 2/2011 | Herr et al. | 463/35 |
| 2011/0173010 | A1* | 7/2011 | Lecomte et al. | 704/500 |
| 2012/0310654 | A1* | 12/2012 | Riedmiller et al. | 704/500 |

FOREIGN PATENT DOCUMENTS

| | | |
|---|---|---|
| WO | 95/02929 | 1/1995 |
| WO | 95/02930 | 1/1995 |
| WO | 02/15587 | 2/2002 |
| WO | 2013/173314 | 11/2013 |

OTHER PUBLICATIONS

Truman, M et al. "Efficient Bit Allocation, Quantization, and Coding in an Audio Distribution System" AES Convention 107 Sep. 24-27, 1999, New York.

ATSC "Digital Audio Compression Standard" (AC-3, E-AC-3), Nov. 22, 2010, published by the Advanced Television Systems Committee, Inc., Washington, D.C.

Andersen, R.L., et al., "Introduction to Dolby Digital Plus, an Enhancement to the Dolby Digital Coding System" AES Convention 117, Oct. 2004, AES.

* cited by examiner

| SNR Offset Difference | Frequency | Cumulative % |
|---|---|---|
| 1 | 8 | 0.01% |
| 0 | 50223 | 51.52% |
| -1 | 40676 | 93.24% |
| -2 | 5658 | 99.04% |
| -3 | 572 | 99.63% |
| -4 | 350 | 99.99% |
| -5 | 10 | 100.00% |
| -6 | 1 | 100.00% |
| Less | 3 | 100.00% |

*FIG. 7*

FIG. 8

| SNR Offset Difference | Frequency | Cumulative % |
|---|---|---|
| 20 | 0 | 0.00% |
| 21 | 5 | 0.01 % |
| 22 | 4 | 0.01 % |
| 23 | 6 | 0.02% |
| 24 | 41 | 0.06% |
| 25 | 62 | 0.12% |
| 26 | 135 | 0.26% |
| 27 | 176 | 0.44% |
| 28 | 259 | 0.71 % |
| 29 | 274 | 0.99% |
| 30 | 463 | 1.46% |
| 31 | 848 | 2.33% |
| 32 | 3612 | 6.04% |
| 33 | 3565 | 9.70% |
| 34 | 5597 | 15.44% |
| 35 | 7507 | 23.14% |
| 36 | 10373 | 33.77% |
| 37 | 10657 | 44.70% |
| 38 | 10698 | 55.68% |
| 39 | 9016 | 64.92% |
| 40 | 11297 | 76.51 % |
| 41 | 5008 | 81.65% |
| 42 | 4184 | 85.94% |
| 43 | 2495 | 88.50% |
| 44 | 2198 | 90.75% |
| 45 | 831 | 91.60% |
| 46 | 506 | 92.12% |
| 47 | 269 | 92.40% |
| 48 | 645 | 93.06% |
| 49 | 175 | 93.24% |
| 50 | 360 | 93.61 % |
| 51 | 561 | 94.18% |
| 52 | 1079 | 95.29% |
| 53 | 931 | 96.25% |
| 54 | 952 | 97.22% |
| 55 | 658 | 97.90% |
| 56 | 1579 | 99.52% |
| 57 | 156 | 99.68% |
| 58 | 155 | 99.83% |

FIG. 11

| SNR Offset Difference | Frequency | Cumulative % |
|---|---|---|
| -47 | 4 | 0.00% |
| -46 | 2 | 0.01% |
| -45 | 8 | 0.01% |
| -44 | 145 | 0.16% |
| -43 | 139 | 0.31% |
| -42 | 277 | 0.59% |
| -41 | 426 | 1.03% |
| -40 | 2150 | 3.23% |
| -39 | 908 | 4.16% |
| -38 | 972 | 5.16% |
| -37 | 623 | 5.80% |
| -36 | 590 | 6.40% |
| -35 | 204 | 6.61% |
| -34 | 118 | 6.73% |
| -33 | 66 | 6.80% |
| -32 | 1282 | 8.12% |
| -31 | 1118 | 9.26% |
| -30 | 3978 | 13.34% |
| -29 | 9319 | 22.90% |
| -28 | 19407 | 42.81 % |
| -27 | 18788 | 62.08% |
| -26 | 16437 | 78.93% |
| -25 | 9183 | 88.35% |
| -24 | 8625 | 97.20% |
| -23 | 1551 | 98.79% |
| -22 | 791 | 99.60% |
| -21 | 245 | 99.85% |
| -20 | 118 | 99.97% |
| -19 | 14 | 99.99% |
| -18 | 6 | 99.99% |
| -17 | 0 | 99.99% |
| -16 | 6 | 100.00% |
| -15 | 0 | 100.00% |
| -14 | 0 | 100.00% |
| -13 | 0 | 100.00% |
| -12 | 1 | 100.00% |
| -11 | 0 | 100.00% |

REDUCED COMPLEXITY CONVERTER SNR CALCULATION

CROSS-REFERENCE TO RELATED APPLICATIONS

The present application is a continuation-in-part of and claims the benefit of the filing date of the following pending PCT International Application which designates the United States: PCT International Application No. PCT/EP2013/072961, filed Nov. 4, 2013 (International Filing Date), entitled "Reduced Complexity Converter SNR Calculation," which claims the benefit of the filing date of U.S. Provisional Patent Application No. 61/723,687, filed Nov. 7, 2012. The present application also claims the benefit of the filing date of U.S. Provisional Patent Application No. 61/723,687, filed Nov. 7, 2012, which is hereby incorporated by reference in its entirety.

TECHNICAL FIELD

The present application relates to audio encoding/decoding. In particular, the present application relates to a method and system for reducing the complexity of a bit allocation process used in the context of audio encoding/decoding. Some embodiments of the invention generate or decode audio data in one of the formats known as AC-3 (e.g., Dolby Digital) or Enhanced AC-3 (e.g., Dolby Digital Plus).

BACKGROUND

Dolby, Dolby Digital, Dolby Digital Plus, and Dolby E are trademarks of Dolby Laboratories Licensing Corporation. Dolby Laboratories provides proprietary implementations of AC-3 and Enhanced AC-3 (sometimes referred to as E-AC-3) known as Dolby Digital and Dolby Digital Plus, respectively.

Various single-channel and/or multi-channel audio rendering systems such as 5.1, 7.1 or 9.1 multi-channel audio rendering systems are currently in use. The audio rendering systems allow e.g. for the generation of a surround sound originating from 5+1, 7+1 or 9+1 speaker locations, respectively. For an efficient transmission or for an efficient storing of the corresponding single-channel or multi-channel audio signals, audio codec (encoder/decoder) systems such as Dolby Digital (DD) or Dolby Digital Plus (DD+) are being used.

There may be a significant installed base of audio rendering devices which are configured to decode audio signals which have been encoded using a particular audio codec system (e.g. Dolby Digital). The particular audio codec system may be referred to as a second audio codec. The evolution of audio codec systems may lead to an updated audio codec system (e.g. Dolby Digital Plus), which may be referred to as a first audio codec system. The updated audio codec system may provide additional features (e.g. an increased number of channels) and/or improved coding quality. As such, content providers may be inclined to provide their content in accordance with the updated audio codec system.

Nevertheless, a user having an audio rendering device with a decoder of the second audio codec system should still be able to render the audio content which has been encoded in accordance with the first audio codec system. This may be achieved by a converter (e.g., transcoder) which is configured to convert first encoded content (audio content which is encoded in accordance with the first audio codec system) into modified audio content which is encoded in accordance with the second audio codec system (typically by decoding the first encoded content to generate decoded content, and then re-encoding the decoded content in accordance with the second audio codec system). In order to reduce the cost of such converters (which may be implemented within set top boxes), the computational complexity of the conversion should be relatively low. For this purpose, the encoder which operates in accordance with the first audio codec system may be configured to insert one or more control parameters into the bitstream comprising the encoded audio content. The one or more control parameters may be used by the converter to perform the conversion with reduced computational complexity. On the other hand, the generation of the one or more control parameters typically increases the computational complexity of the encoder.

In the present document, methods and systems are described which enable conversion of audio content from a first format (according to a first audio codec system) into a second format (according to a second audio codec system) with reduced computational complexity. The methods and systems described in the present document may be used to reduce the computational complexity at the encoder and/or at the converter.

SUMMARY

An aspect of the invention is an audio encoder configured to encode an audio signal in accordance with a first audio codec system. The audio signal may comprise a multi-channel audio signal, e.g., a 5.1, a 7.1 or a 9.1 multi-channel audio signal. The audio signal may be divided into a sequence of segments (e.g., frames), wherein the frames may comprise a pre-determined number of samples of the audio signal, e.g., 1536 samples. The first audio codec system may comprise or may conform to a Dolby Digital Plus codec system (e.g., a Low Complexity Dolby Digital Plus or "LC DD+" system) or other E-AC-3 codec system. The audio encoder may be configured to encode the audio signal into a first bitstream at a first target data rate. Examples of the first target data rate are 384 kbps, 448 kpbs or 640 kbps (notably in the case of a 5.1 multi-channel audio signal). Other first target data rates are possible, notably for other types of multi-channel audio signals.

The audio encoder may comprise a transform unit configured to determine a set of spectral coefficients based on a segment (e.g., frame) of the audio signal. In other words, the transform unit may be configured to determine one or more spectral components of the audio signal. The transform unit may be configured to determine a plurality of blocks from the frame of the audio signal. Furthermore, the transform unit may be configured to transform the blocks of samples from the time-domain into the frequency-domain. By way of example, the transform unit may be configured to perform a Modified Discrete Cosine Transform (MDCT) on the one or more blocks derived from the frame of the audio signal.

The encoder may comprise a floating-point encoding unit configured to determine a set of scale factors and a set of scaled values, based on the set of spectral coefficients. The scale factors may correspond to exponents e and the scaled values may correspond to mantissas m. The floating-point encoding unit may be configured to determine an exponent e and a mantissa m for a transform coefficient X such that $X=m\cdot 2^{-e}$. By doing this for all the spectral coefficients from the set of spectral coefficients, the set of scale factors and the set of scaled values may be determined.

Furthermore, the floating-point encoding unit may be configured to encode the set of scale factors to yield a set of encoded scale factors. The encoding of the set of scale factors may e.g. be based on the scale factors for all of the blocks of a frame of the audio signal. The encoding may result in a modification of a scale factor, such that the encoded scale factors represent values which are different from the values of the scale factors.

The encoder may comprise a bit allocation and quantization unit configured to determine a total number of available bits for quantizing the set of scaled values, based on the first target data rate and based on the number of bits used for the set of encoded scale factors. For this purpose, the first target data rate may be translated into a total number of bits per frame and the number of bits used for the set of encoded scale factors (as well as bits that may be reserved for or may have been used for other purposes) may be subtracted from the total number of bits, thereby yielding the total number of available bits for quantizing the set of scaled values.

The bit allocation and quantization unit may be configured to perform an iterative bit allocation process for determining the resolution of a quantizer for quantizing the scaled values. The resolution of the quantizer should be determined such that the total number of available bits for quantizing the set of scaled values is not exceeded and such that a perceptual quantization noise is minimized (or reduced). The quantizer which meets this requirement may be identified using a first control parameter. In other words, the bit allocation and quantization unit may be configured to determine a first control parameter indicative of an allocation of the total number of available bits for quantizing the scaled values of the set of scaled values, i.e. indicative of a quantizer for quantizing the scaled values of the set of scaled values. The first control parameter may be or comprise a Dolby Digital Plus snroffset (or SNR offset) value.

By way of example, the bit allocation and quantization unit may be configured to determine the first control parameter by determining a power spectral density (PSD) distribution of the set of transform coefficients based on the set of encoded scale factors. The set of encoded scale factors is typically inserted into the first bitstream and therefore known to a corresponding decoder (e.g., transcoder). As such, the PSD distribution may also be determined at the corresponding decoder (e.g., transcoder). Furthermore, the bit allocation and quantization unit may be configured to determine a masking curve based on the set of encoded scale factors. Hence, the masking curve is typically also derivable at the corresponding decoder (e.g., transcoder). The masking curve may be indicative of the masking between neighboring spectral components (i.e. spectral components at adjacent frequencies) or transform coefficients of the audio signal. In addition, the bit allocation and quantization unit may be configured to determine an offset masking curve by offsetting the masking curve using an intermediate first control parameter. In particular, the intermediate first control parameter may be used to move up/down the offset masking curve, thereby yielding less/more spectral components that are masked, i.e. thereby yielding less/more spectral components that need to be quantized. The bit allocation and quantization unit may be further configured to determine a number of required bits for quantizing the scaled values of the set of scaled values, based on a comparison of the PSD distribution and of the offset masking curve. The intermediate first control parameter may be adjusted (in an iterative manner) such that a difference between the number of required bits and the total number of available bits is reduced (e g minimized), thereby yielding the first control parameter as the intermediate first control parameter which reduces (e g minimizes) the difference. Typically, the difference should be such that the number of required bits does not exceed the total number of available bits.

As a result of the above mentioned iterative bit allocation process, a first control parameter defining a quantizer for quantizing the set of scaled values is obtained. The bit allocation and quantization unit may be configured to quantize the set of scaled values in accordance with the first control parameter to yield a set of quantized scaled values.

The encoder may further comprise a transcoding simulation unit configured to derive a second control parameter for enabling a converter (e.g., transcoder) to convert a first bitstream (encoded in accordance with a first audio codec system and having a first target data rate) into a second bitstream (encoded in accordance with a second audio codec system at a second target data rate). Typically, the second audio codec system is significantly different from the first audio codec system (but alternatively, it may be substantially similar to the first audio codec system, e.g., if the first audio codec system is an LC DD+ codec system and the second audio codec system is the Dolby Digital codec system). By way of example, the second codec system may be or conform to a Dolby Digital (DD) codec system (or other AC-3 codec system) and the second control parameter may correspond to or may comprise a Dolby Digital SNR offset value. The second target data rate (sometimes referred to as a target data rate) may be 640 kpbs (notably in the case of a 5.1 multi-channel audio signal). It should be noted that other second target data rates are possible, notably for other types of multi-channel audio signals. The second target data rate may be equal to, less than, or greater than the first target data rate.

The transcoding simulation unit may be configured to derive the second control parameter from the first control parameter. In particular, the transcoding simulation unit may be configured to derive the second control parameter from the first control parameter alone. In an embodiment, the transcoding simulation unit is configured to derive the second control parameter without performing a bit allocation process in accordance with the second audio codec system. In a particular embodiment, the transcoding simulation unit may be configured to set a value of the second control parameter equal to a value of the first control parameter. As such, the encoder may be configured to determine the second control parameter at a reduced computational complexity. The first control parameter may comprise a coarse component and a fine component. By way of example (in case of a DD/DD+ audio codec system), the first control parameter may comprise a csnroffset parameter and a fsnroffset parameter). The transcoding simulation unit may be configured to combine the coarse and fine components to yield the second control parameter (e.g., the convsnroffset parameter).

In addition, the encoder may comprise a bitstream packing unit configured to generate the first bitstream comprising the set of quantized scaled values, the set of encoded scale factors, the first control parameter and/or the second control parameter. The first bitstream may be provided to a corresponding decoder. Alternatively or in addition, the first bitstream may be provided to a converter (e.g., transcoder) configured to convert the first bitstream into the second bitstream. The bitstream packing unit may be configured to insert one or more skip bits (which may also be referred to as waste bits or unused bits or fill bits) into the first bitstream such that the first bitstream conforms to the first target data rate.

The first bitstream may conform to a first format and the second bitstream may conform to a second format. The transcoding simulation unit may be configured to determine a number of excess bits required by the second format to represent the set of quantized scaled values and the set of encoded scale factors. In other words, the transcoding simulation unit may be configured to determine the number of excess bits as the number of additional bits which are required to represent the audio signal in accordance with the second format compared to a representation in accordance with the first format. The number of excess bits may be determined specifically for the frame of the audio signal or the number of excess bits may be a pre-determined value, e.g. a worst-case value. The bit allocation and quantization unit of the encoder may be configured to determine the total number of available bits also based on the number of excess bits. In particular, the bit allocation and quantization unit may be configured to reduce the total number of available bits by the number of excess bits. By doing this, it can be ensured that the second bitstream does not exceed the second target data rate (notably in the case where the first target data rate corresponds to or is equal to the second target data rate).

The transcoding simulation unit may be configured to determine a default second control parameter based on the first control parameter, e.g. a default second control parameter which corresponds to or is equal to the first control parameter. Furthermore, the transcoding simulation unit may be configured to determine whether a default second bitstream which is transcoded based on the default second control parameter exceeds the second target data rate. In other words, the transcoding simulation unit may be configured to simulate a transcoder which converts the first bitstream into the second bitstream using the default second control parameter. For this purpose, the transcoding simulation unit may be configured to de-quantize the set of quantized scaled values using the first control parameter to yield a set of de-quantized scaled values, and to re-quantize the set of de-quantized scaled values using the default second control parameter to yield a set of re-quantized scaled values.

If the default second bitstream does not exceed the second target data rate, the transcoding simulation unit may be configured to determine the second control parameter based on the default second control parameter. By way of example, the second control parameter may be set equal to the default second control parameter. As such, it is ensured—without the need to perform an explicit and/or iterative bit allocation process in accordance with the second audio codec system—that the second bitstream does not exceed the second target data rate.

On the other hand, if it is determined that the default second bitstream exceeds the second target data rate, the transcoding simulation unit may be configured to perform bit allocation and quantization in accordance with the second audio codec system to determine the second control parameter such that the second bitstream which is transcoded based on the second control parameter does not exceed the second target data rate. In other words, only if it is determined that the default second bitstream exceeds the second target data rate, it may be necessary to perform a bit allocation and quantization process in accordance with the second audio codec system.

The bit allocation and quantization process in accordance with the second audio codec system may comprise determining a second total number of available bits for quantizing the set of de-quantized scaled values, based on the second target data rate and based on the number of bits used for re-encoding the set of encoded scale factors in accordance with the second audio codec system. Furthermore, the bit allocation and quantization process may comprise determining a second control parameter indicative of an allocation of the second total number of available bits for quantizing the scaled values of the set of de-quantized scaled values.

The determination of the second control parameter may be performed in conjunction with an iterative bit allocation process. This iterative bit allocation process may comprise determining a power spectral density (PSD) distribution based on the set of encoded scale factors (e.g. based on the set of encoded scale factors which are encoded in accordance with the second audio codec system). Furthermore, the iterative bit allocation process may comprise determining a masking curve based on the set of encoded scale factors. An offset masking curve may be determined by offsetting the masking curve using an intermediate second control parameter. Furthermore, a number of required bits for quantizing the de-quantized scaled values of the set of de-quantized scaled values may be determined, based on a comparison of the PSD distribution and of the offset masking curve. The intermediate second control parameter may be adjusted in an iterative process, such that a difference between the number of required bits and the second total number of available bits is reduced (e.g. minimized), thereby yielding the second control parameter. In other words, the transcoding simulation unit may be configured to perform an iterative bit allocation process in accordance with the second audio codec system, which is similar to (e.g. equal to) the bit allocation process in accordance with the first audio codec system.

The transcoding simulation unit may be configured to initialize the intermediate second control parameter with the first control parameter, thereby potentially reducing the number of iterations which are required to determine a second control parameter which meets the requirements with regards to the second target data rate and/or with regards to quantization noise. Alternatively or in addition, the transcoding simulation unit may be configured to stop the iterative procedure if a quantization noise determined based on the comparison of the PSD distribution and of the offset masking curve falls below a pre-determined noise threshold, thereby potentially reducing the number of required iterations.

Alternatively or in addition, if it is determined that the default second bitstream exceeds the second target data rate, the transcoding simulation unit may be configured to determine the second control parameter by offsetting the default second control parameter by a pre-determined control parameter offset value. The pre-determined control parameter offset value may e.g. be determined based on the bit allocation and quantization process performed in accordance with the first audio codec system. This bit allocation and quantization process which is performed by the bit allocation and quantization unit may provide an indication on how much the second control parameter should be offset, so that the second bitstream meets the second target data rate (e.g. does not exceed the second target data rate).

According to a further aspect, an audio converter (e.g., an audio transcoder) configured to receive a first bitstream (having a first target data rate) is described. As outlined above, the first bitstream may be indicative of a frame of an audio signal encoded in accordance with a first audio codec system. The first bitstream may comprise a set of quantized scaled values, a set of encoded scale factors, a first control parameter and a second control parameter. The set of quantized scaled values and the set of encoded scale factors may be indicative of spectral components of the frame of the audio signal, and the first control parameter may be indicative of a resolution of a quantizer used to quantize the set of quantized scaled values. The second control parameter may be indicative of a quantizer to be used by the converter to re-quantize the set of quantized scaled values for a second bitstream at a second target data rate, wherein the second bitstream accords to a second audio codec system different from the first audio codec system.

The converter may be configured to determine whether the first target data rate is equal to the second target data rate and to determine whether the first control parameter corresponds to the second control parameter. If the first target data rate is equal to the second target data rate and if the first control parameter corresponds to the second control parameter, the converter may be configured to determine the second bitstream by copying the set of quantized scaled values, the set of encoded scale factors, and the second control parameter to the second bitstream. As such, the converter may be configured to generate the second bitstream without the need to de-quantize the set of quantized scaled values (using the first control parameter), and without the need to re-quantize the de-quantized scaled values (using the second control parameter). Consequently, the computational complexity of the converter can be reduced.

If the first target data rate is smaller than the second target data rate and if the first control parameter corresponds to the second control parameter, the converter may be configured to determine whether the first bitstream comprises a coupling channel and/or a full channel (e.g. in case of multi-channel audio signals). The converter may be configured to copy the quantized scaled values of the set of quantized scaled values and the encoded scale factors of the set of encoded scale factors which are associated with the full channel to the second bitstream. As such, for full channels, the converter does not need to de-quantize the set of quantized scaled values (which are associated with the full channel), and to re-quantize the de-quantized scaled values (which are associated with the full channel), thereby reducing the computational complexity of the converter.

Furthermore, the audio converter may be configured to de-couple the quantized scaled values of the set of quantized scaled values and the encoded scale factors of the set of encoded scale factors which are associated with the coupling channel, thereby yielding a first set of quantized scaled values and a first set of encoded scale factors. Furthermore, the converter may be configured to de-quantize the first set of quantized scaled values using the first control parameter to yield a first set of de-quantized scaled values, to re-quantize the first set of de-quantized scaled values using the second control parameter, thereby yielding a first set of re-quantized scaled values. The first set of re-quantized scaled values may be inserted into the second bitstream. As such, a decoder of the second audio codec system is provided with a second bitstream which does not comprise coupling channels, i.e. which only comprised full channels.

According to another aspect, a method for encoding (and a corresponding encoder) an audio signal in accordance with a first audio codec into a first bitstream is described. The method comprises determining a set of scale factors and a set of scaled values, based on spectral components (e.g. based on a set of transform coefficients) of the audio signal. The method proceeds with determining a first control parameter indicative of a resolution of a quantizer for quantizing the set of scaled values using an iterative bit allocation process in accordance with the first audio codec system. The resolution of the quantizer may be dependent on a first target data rate of the first bitstream. In addition, the method may comprise determining a second control parameter for enabling a conversion of the first bitstream into a second bitstream at a second target data rate. As outlined above, the second bitstream may accord to a second audio codec system different from the first audio codec system. The step of determining the second control parameter may comprise determining the second control parameter based on the first control parameter, e.g. without performing an iterative bit allocation process in accordance with the second audio codec system. As outlined above, the determination of the second control parameter based on the first control parameter may be subjected to one or more conditions (e.g. with respect to the second bitstream meeting the second target data rate). The first bitstream may be indicative of the first and second control parameters.

According to a further aspect, a method for transcoding (and a corresponding transcoder) a first bitstream indicative of an audio signal encoded in accordance with a first audio codec system into a second bitstream encoded in accordance with a second audio codec system different from the first audio codec system is described. The method comprises receiving the first bitstream at a first target data rate. The first bitstream may comprise a set of quantized scaled values, a set of encoded scale factors, a first control parameter and a second control parameter. The set of quantized scaled values and the set of encoded scale factors may be indicative of spectral components of the audio signal, and the first control parameter may be indicative of a quantizer used to quantize the set of quantized scaled values. The second control parameter may be indicative of a quantizer to be used by the transcoder to re-quantize the set of quantized scaled values for a second bitstream at a second target data rate. The method may further comprise determining whether the first target data rate is equal to the second target data rate, and determining whether the first control parameter corresponds to the second control parameter. If the first target data rate is equal to the second target data rate and if the first control parameter corresponds to (e.g. is equal in value to) the second control parameter, the method may proceed in determining the second bitstream by copying the set of quantized scaled values, the set of encoded scale factors, and the second control parameter to the second bitstream.

According to another aspect, an audio encoder (and a corresponding method) configured to encode an audio signal in accordance with an E-AC-3 or Dolby Digital Plus codec system, thereby yielding a first bitstream at a first target data rate, is described. The audio encoder may be configured to determine a snroffset parameter for the first target data rate in accordance with the E-AC-3 or Dolby Digital Plus codec system. Furthermore, the encoder may be configured to derive a convsnroffset parameter from the snroffset parameter, for enabling a converter to convert the first bitstream into a second bitstream at a second target data rate. The second bitstream may accord to an AC-3 or Dolby Digital codec system, and the first bitstream may comprise the snroffset parameter and the convsnroffset parameter.

According to a further aspect, a method of enabling the conversion of a first bitstream corresponding to a first format into a second bitstream corresponding to a second format is described. Furthermore, a corresponding apparatus (notably a corresponding audio encoder) is described, which is configured to perform the method of enabling the conversion. The actual conversion of the first bitstream into the second bitstream may be performed by a different entity (e.g. by a transcoder).

The first and second formats may correspond to the formats of the first and second audio codec systems described in the present document. The first and second bitstreams are typically related to at least one and the same frame of an encoded audio signal. In other words, the first and second bitstreams typically describe corresponding one or more frames of an audio signal. The first bitstream includes a first control parameter indicative of a first bit allocation process associated with the first bitstream. The first bit allocation process may be performed in accordance with the first audio codec system. As outlined in the present document, the first control parameter may comprise a coarse component and a fine component.

The second bitstream may include a second control parameter indicative of a second bit allocation process associated with the second bitstream. The second bit allocation process may be performed in accordance with the second audio codec system. Furthermore, the second bitstream may be generated from the first bitstream using the second control parameter. In particular, the second control parameter may be used by a converter (which may be remote to the encoder) to transform the first bitstream into the second bitstream.

The method may comprise determining the second control parameter solely based on the first control parameter. In particular, the second control parameter may be determined solely based on a combination of the coarse and fine components of the first control parameter. Furthermore, the method may comprise inserting the second control parameter into the first bitstream. As such, the first bitstream (comprising the first and second control parameters) may be transmitted to a converter, thereby enabling the converter to determine the second bitstream from the first bitstream at reduced computational complexity (and without the need of transmitting the second bitstream).

According to a further aspect an audio transcoder (and a corresponding transcoding method) is described. The audio transcoder is configured to receive a first bitstream at a first target data rate. The first bitstream may be indicative of an audio signal encoded in accordance with an E-AC-3 or Dolby Digital Plus codec system. The first bitstream may comprise a set of quantized scaled values, a snroffset parameter and a convsnroffset parameter. The convsnroffset parameter may be indicative of a quantizer to be used by the transcoder to generate a second bitstream at a second target data rate, wherein the second bitstream accords to an AC-3 or Dolby Digital audio codec system. The transcoder may be configured to determine whether the first target data rate is equal to the second target data rate and to determine whether the snroffset parameter corresponds to the convsnroffset parameter. If the first target data rate is equal to the second target data rate and if the snroffset parameter corresponds to the convsnroffset parameter, the transcoder may be configured to determine the second bitstream by copying the set of quantized scaled values and the convsnroffset parameter to the second bitstream.

According to a further aspect, a software program is described. The software program may be adapted for execution on a processor and for performing the method steps outlined in the present document when carried out on the processor.

According to another aspect, a storage medium is described. The storage medium may comprise a software program adapted for execution on a processor and for performing the method steps outlined in the present document when carried out on the processor.

According to a further aspect, a computer program product is described. The computer program may comprise executable instructions for performing the method steps outlined in the present document when executed on a computer.

It should be noted that the methods and systems including its preferred embodiments as outlined in the present patent application may be used stand-alone or in combination with the other methods and systems disclosed in this document. Furthermore, all aspects of the methods and systems outlined in the present patent application may be arbitrarily combined. In particular, the features of the claims may be combined with one another in an arbitrary manner.

BRIEF DESCRIPTION OF THE DRAWINGS

FIG. 7 is a table of data generated by analyzing results of operation of a DD+ encoder (running at 640 Kbps) to encode frames of audio data.

FIG. 8 is a table of data generated by analyzing results of operation of the DD+ encoder (running at 448 Kbps) to encode the same frames of audio data.

FIG. 11 is a table of data generated by analyzing results of operation of the DD+ encoder (running at 768 Kbps) to encode the same frames of audio data.

DETAILED DESCRIPTION

Figure 1A:
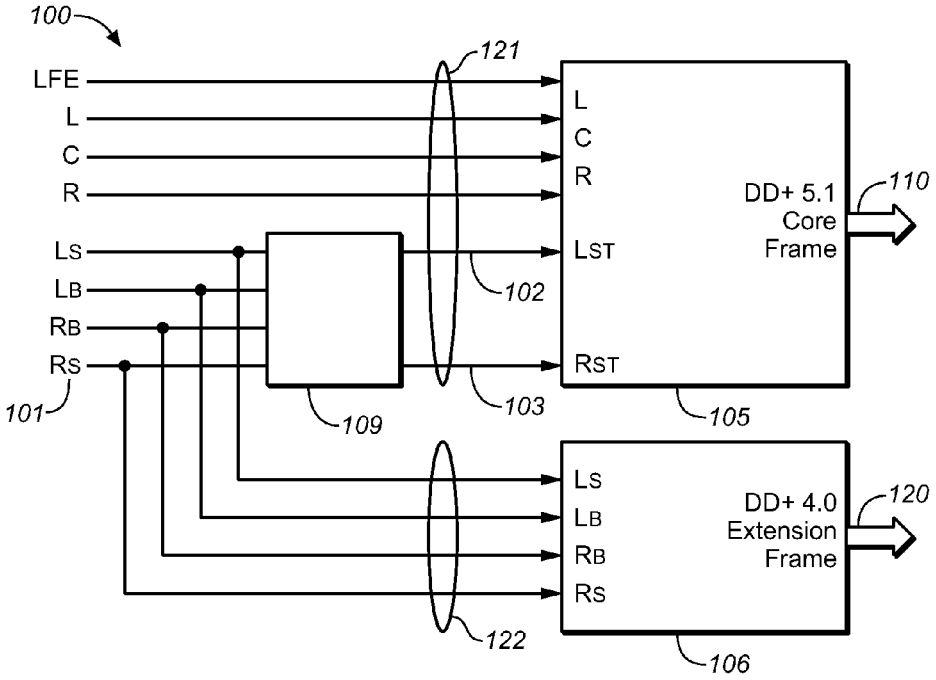
FIG. 1A is a high level block diagram of an example multi-channel audio encoder.

It is desirable to provide multi-channel audio codec systems which generate bitstreams that are downward compatible with regards to the number of channels which are decoded by a particular multi-channel audio decoder. In particular, it is desirable to encode an M.1 multi-channel audio signal such that it can be decoded by an N.1 multi-channel audio decoder, with N<M. By way of example, it is desirable to encode a 7.1 audio signal such that it can be decoded by a 5.1 audio decoder. In order to allow for downward compatibility, multi-channel audio codec systems typically encode an M.1 multi-channel audio signal into an independent (sub) stream ("IS"), which comprises a reduced number of channels (e.g., N.1 channels), and into one or more dependent (sub)streams ("DS"), which comprise replacement and/or extension channels in order to decode and render the full M.1 audio signal.

Furthermore, it is desirable to provide a bitstream which enables a previous version of an audio decoder to decode the bitstream generated by an updated version of an audio encoder. In other words, it is desirable to allow for downward compatibility with regards to the decoding of a bitstream (even for bitstreams representing the same number N.1 of channels). This may be achieved by the use of a converter (e.g., transcoder) which converts a bitstream that has been encoded using the updated version of the audio encoder into a bitstream that can be decoded by the previous version of the audio decoder. Such a converter may be provided (for example) in a set top box which is configured to receive the bitstream (encoded using the updated version of the audio encoder) and which is configured to provide a modified bitstream which can be decoded by the previous version of the audio decoder. By way of example, the converter may be configured to receive a Dolby Digital Plus (DD+) or E-AC-3 bitstream and transcode the received bitstream into a Dolby Digital (DD) or AC-3 bitstream which can be decoded by a Dolby Digital or AC-3 audio decoder. As such, an installed base of audio decoders (e.g. of Dolby Digital audio decoders within television sets) can be protected, while at the same time not blocking the evolution to improved audio encoding/decoding systems (such as the Dolby Digital Plus codec system).

In this context, it is desirable to reduce the computational complexity linked to the encoding of a bitstream and/or linked to the transcoding of the bitstream. In the present document, methods and systems are described which enable the generation of a bitstream with a reduced computational complexity. The methods and systems are described based on the Dolby Digital Plus (DD+) codec system (and the enhanced AC-3, or E-AC-3 codec system). The E-AC-3 codec system is specified in the Advanced Television Systems Committee (ATSC) "Digital Audio Compression Standard (AC-3, E-AC-3)", Document A/52:2010, dated 22 Nov. 2010, the content of which is incorporated by reference. It should be noted, however, that the methods and systems described in the present document are generally applicable and may be applied to other audio codec systems which encode audio signals and which provide a bitstream to a transcoder, such that the bitstream enables a low complexity transcoding of the bitstream.

Frequently used multi-channel configurations (and multi-channel audio signals) are the 7.1 configuration and the 5.1 configuration. A 5.1 multi-channel configuration typically comprises an L (left front), a C (center front), an R (right front), an Ls (left surround), an Rs (right surround), and an LFE (Low Frequency Effects) channel. A 7.1 multi-channel configuration further comprises a Lb (left surround back) and a Rb (right surround back) channel. An example 7.1 multi-channel configuration is illustrated in FIG. 2*b*. In order to transmit 7.1 channels in DD+, two substreams are used. The first substream (referred to as the independent substream, "IS") comprises a 5.1 channel mix, and the second substream (referred to as the dependent substream, "DS") comprises extension channels and replacement channels. For example, in order to encode and transmit a 7.1 multi-channel audio signal with surround back channels Lb and Rb, the independent substream carries the channels L (left front), C (center front), R (right front), Lst (left surround downmixed), Rst (right surround downmixed), LFE (Low Frequency Effects), and the dependent channel carries the extension channels Lb (left surround back), Rb (right surround back) and the replacement channels Ls (left surround), Rs (right surround). When a full 7.1 signal decode is performed, the Ls and Rs channels from the dependent substream replace the Lst and Rst channels from the independent substream.

FIG. 1*a* is a high level block diagram of an example DD+7.1 multi-channel audio encoder 100 illustrating the relationship between 5.1 and 7.1 channels. The seven (7) plus one (1) audio channels 101 (L, C, R, Ls, Lb, Rs and Rb plus LFE) of the multi-channel audio signal are split into two groups of audio channels. A basic group 121 of channels comprises the audio channels L, C, R and LFE, as well as downmixed surround channels Lst 102 and Rst 103 which are typically derived from the 7.1 surround channels Ls, Rs and the 7.1 back channels Lb, Rb. By way of example, the downmixed surround channels 102, 103 are derived by adding some or all of the Lb and Rb channels and the 7.1 surround channels Ls, Rs in a downmix unit 109. It should be noted that the downmixed surround channels Lst 102 and Rst 103 may be determined in other ways. By way of example, the downmixed surround channels Lst 102 and Rst 103 may be determined directly from two of the 7.1 channels, for example, the 7.1 surround channels Ls, Rs.

Figure 1B:
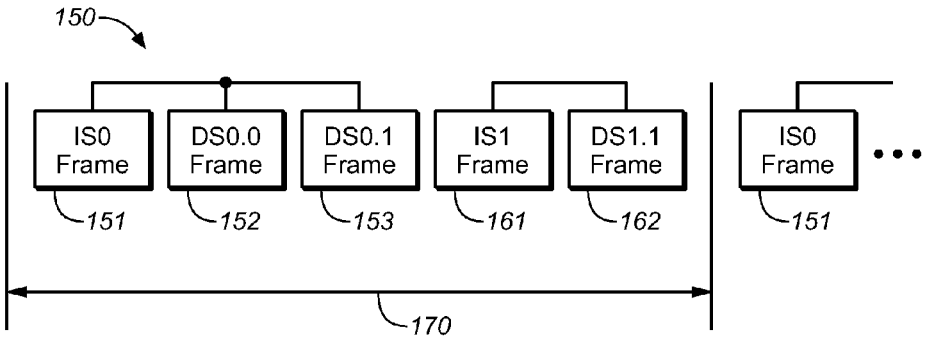
FIG. 1B shows an example sequence of encoded frames.

The basic group 121 of channels is encoded in a DD+5.1 audio encoder 105, thereby yielding the independent substream ("IS") 110 which is transmitted in a DD+ core frame 151 (see FIG. 1*b*). The core frame 151 is also referred to as an IS frame. A second group 122 of audio channels comprises the 7.1 surround channels Ls, Rs and the 7.1 surround back channels Lb, Rb. The second group 122 of channels is encoded in a DD+4.0 audio encoder 106, thereby yielding a dependent substream ("DS") 120 which is transmitted in one or more DD+ extension frame 152, 153 (see FIG. 1*b*). The second group 122 of channels is referred herein as the extension group 122 of channels and the extension frames 152, 153 are referred to as DS frames 152. 153.

FIG. 1*b* illustrates an example sequence 150 of encoded audio frames 151, 152, 153, 161, 162. The illustrated example comprises two independent substreams IS0 and IS1 comprising the IS frames 151 and 161, respectively. Multiple IS (and respective DS) may be used to provide multiple associated audio signals (e.g., for different languages of a movie or for different programs). Each of the independent substreams comprises one or more dependent substreams DS0, DS1, respectively. Each of the dependent substreams comprises respective DS frames 152, 153 and 162. Furthermore, FIG. 1*b* indicates the temporal length 170 of a complete audio frame of the multi-channel audio signal. The temporal length 170 of the audio frame may be 32 ms (e.g., at a sampling rate fs=48 kHz). In other words, FIG. 1*b* indicates the length in time 170 of an audio frame which is encoded into one or more IS frames 151, 161 and respective DS frames 152, 153, 162.

The encoder 100 may be configured to include data into the substreams which allows for an efficient transcoding of the substreams into a different coding format. By way of example, the substreams may comprise data which allows transcoding of a DD+ independent substream IS0 into a DD bitstream. In more general terms, the encoder 100 may be configured to generate a first bitstream which is compatible to a first audio codec (e.g. DD+). The first bitstream may comprise data which allows a transcoder to generate a second bitstream which is compatible with a second audio codec (e.g. DD) at a reduced complexity. For this purpose, the encoder 100 may be configured to encode some or all of the audio channels 101 in accordance with the second audio codec (e.g. DD) and determine one or more control parameters, which enable the transcoder to generate the second bitstream from the first bitstream in an efficient manner. It should be noted that in view of bandwidth efficiency, the first bitstream should only comprise audio data which is encoded in accordance with the first audio codec, and not audio data which is encoded in accordance with the second audio codec. In other words, the one or more control parameters should only relate to the transcoding of the audio data.

Figure 2A:
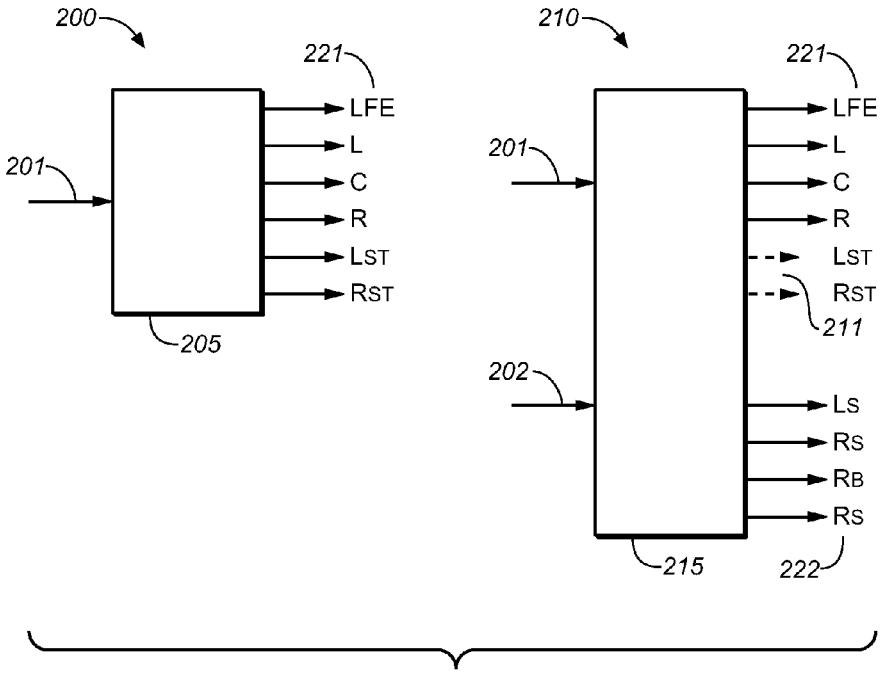
FIG. 2A is a high level block diagram of example multi-channel audio decoders.
Figure 2B:
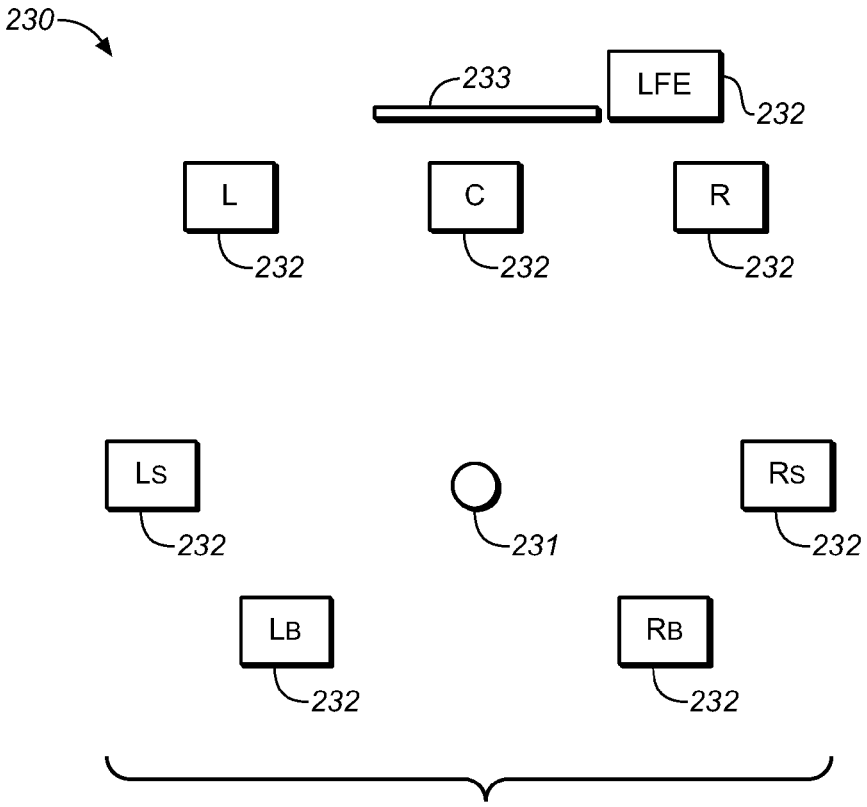
FIG. 2B shows an example loudspeaker arrangement for a 7.1 multi-channel audio signal.

FIG. 2*a* illustrates high level block diagrams of example multi-channel decoder systems 200, 210. In particular, FIG. 2*a* shows an example 5.1 multi-channel decoder system 200 which receives the encoded IS 201 comprising the encoded basic group 121 of channels. The encoded IS 201 is taken from the IS frames 151 of a received bitstream (e.g., using a demultiplexer which is not shown). The IS frames 151 comprise the encoded basic group 121 of channels and are decoded using a 5.1 multi-channel decoder 205, thereby yielding a decoded 5.1 multi-channel audio signal comprising the decoded basic group 221 of channel. Furthermore, FIG. 2*a* shows an example 7.1 multi-channel decoder system 210 which receives the encoded IS 201 comprising the encoded basic group 121 of channels and the encoded DS 202 comprising the encoded extension group 122 of channels. As outlined above, the encoded IS 201 may be taken from the IS frames 151 and the encoded DS 202 may be taken from the DS frames 152, 153 of the received bitstream (e.g., using a demultiplexer which is not shown). After decoding, a decoded 7.1 multi-channel audio signal comprising the decoded basic group 221 of channels and a decoded extension group 222 of channels is obtained. It should be noted that the downmixed surround channels Lst, Rst 211 may be dropped, as the 7.1 multi-channel decoder 215 makes use of the decoded extension group 222 of channels instead. Typical rendering positions 232 of a 7.1 multi-channel audio signal are shown in the multi-channel configuration 230 of FIG. 2*b*, which also illustrates an example position 231 of a listener and an example position 233 of a screen for video rendering.

Currently, the encoding of 7.1 channel audio signals in DD+ is performed by a first core 5.1 channel DD+ encoder 105 and a second DD+ encoder 106. The first DD+ encoder 105 encodes the 5.1 channels of the basic group 121 (and may therefore be referred to as a 5.1 channel encoder) and the second DD+ encoder 106 encodes the 4.0 channels of the extension group 122 (and may therefore be referred to as a 4.0 channel encoder). The encoders 105, 106 for the basic group 121 and the extension group 122 of channels typically do not have any knowledge of each other. Each of the two encoders 105, 106 is provided with a data rate, which corresponds to a fixed portion of the total available data rate. In other words, the encoder 105 for the IS and the encoder 106 for the DS are provided with a fixed fraction of the total available data rate (e.g., Z % of the total available data rate for the IS encoder 105 (referred to as the "IS data rate") and 100%−Z % of the total available data rate for the DS encoder 106 (referred to as the "DS data rate"), e.g., Z=50). Using the respectively assigned data rates (i.e., the IS data rate and the DS data rate), the IS encoder 105 and the DS encoder 106 perform an independent encoding of the basic group 121 of channels and of the extension group 122 of channels, respectively.

In the following, further details regarding the components of the IS encoder 105 and the DS encoder 106 are described in the context of FIG. 3, which shows a block diagram of an example DD+ multi-channel encoder 300. The IS encoder 105 and/or to the DS encoder 106 may be embodied by the DD+ multi-channel encoder 300 of FIG. 3. Subsequent to describing the components of the encoder 300, it is described how the multi-channel encoder 300 may be adapted to enable an efficient transcoding from a first bitstream (encoded using a first audio codec system) to a second bitstream (encoded using a second audio codec system).

The multi-channel encoder 300 receives streams 311 of PCM samples corresponding to the different channels of the multi-channel input signal (e.g., of the 5.1 input signal). The streams 311 of PCM samples may be arranged into frames of PCM samples. Each of the frames may comprise a pre-determined number of PCM samples (e.g., 1536 samples) of a particular channel of the multi-channel audio signal. As such, for each time segment of the multi-channel audio signal, a different audio frame is provided for each of the different channels of the multi-channel audio signal. The multi-channel audio encoder 300 is described in the following for a particular channel of the multi-channel audio signal. It should be noted, however, that the resulting AC-3 frame 318 typically comprises the encoded data of all the channels of the multi-channel audio signal.

An audio frame comprising PCM samples 311 may be filtered in an input signal conditioning unit 301. Subsequently, the (filtered) samples 311 may be transformed from the time-domain into the frequency-domain in a Time-to-Frequency Transform subsystem (unit) 302. For this purpose, the audio frame may be subdivided into a plurality of blocks of samples. The blocks may have a pre-determined length L (e.g., 256 samples per block). Furthermore, adjacent blocks may have a certain degree of overlap (e.g., 50% overlap) of samples from the audio frame. The number of blocks per audio frame may depend on a characteristic of the audio frame (e.g., the presence of a transient). Typically, the Time-to-Frequency Transform unit 302 applies a Time-to-Frequency Transform (e.g., a MDCT (Modified Discrete Cosine Transform) Transform) to each block of PCM samples derived from the audio frame. As such, for each block of samples a block of transform coefficients 312 is obtained at the output of the Time-to-Frequency Transform unit 302.

Each channel of the multi-channel input signal may be processed separately, thereby providing separate sequences of blocks of transform coefficients 312 for the different channels of the multi-channel input signal. In view of correlations between some of the channels of the multi-channel input signal (e.g., correlations between the surround signals Ls and Rs), a joint channel processing may be performed in joint channel processing unit 303. In an example embodiment, the joint channel processing unit 303 performs channel coupling, thereby converting a group of coupled channels into a single composite channel plus coupling side information which may be used by a corresponding decoder system 200, 210 to reconstruct the individual channels from the single composite channel. By way of example, the Ls and Rs channels of a 5.1 audio signal may be coupled or the L, C, R, Ls, and Rs channels may be coupled. If coupling is used in unit 303, only the single composite channel is submitted to the further processing units shown in FIG. 3. Otherwise, the individual channels (i.e., the individual sequences of blocks of transform coefficients 312) are passed to the further processing units of the encoder 300.

In the following, the further processing subsystems (units) of the encoder are described for an exemplary sequence of blocks of transform coefficients 312. The description is applicable to each of the channels which are to be encoded (e.g., to the individual channels of the multi-channel input signal or to one or more composite channels resulting from channel coupling).

The block floating-point encoding unit 304 is configured to convert the transform coefficients 312 of a channel (applicable to all channels, including the full bandwidth channels (e.g., the L, C and R channels), the LFE (Low Frequency Effects) channel, and the coupling channel) into an exponent/mantissa format. By converting the transform coefficients 312 into an exponent/mantissa format, the quantization noise which results from the quantization of the transform coefficients 312 can be made independent of the absolute input signal level.

Typically, the block floating-point encoding performed in unit 304 may convert each of the transform coefficients 312 into an exponent and a mantissa. The exponents are to be encoded as efficiently as possible in order to reduce the data rate overhead required for transmitting the encoded exponents 313. At the same time, the exponents should be encoded as accurately as possible in order to avoid losing spectral resolution of the transform coefficients 312. In the following, an exemplary block floating-point encoding scheme is briefly described which is used in DD+ (and in DD) to achieve the above mentioned goals. For further details regarding the DD+ encoding scheme (and in particular, the block floating-point encoding scheme used by DD+) reference is made to the document Fielder, L. D. et al. "Introduction to Dolby Digital Plus, and Enhancement to the Dolby Digital Coding System", AEC Convention, 28-31 Oct. 2004, the content of which is incorporated by reference.

Figure 4A:
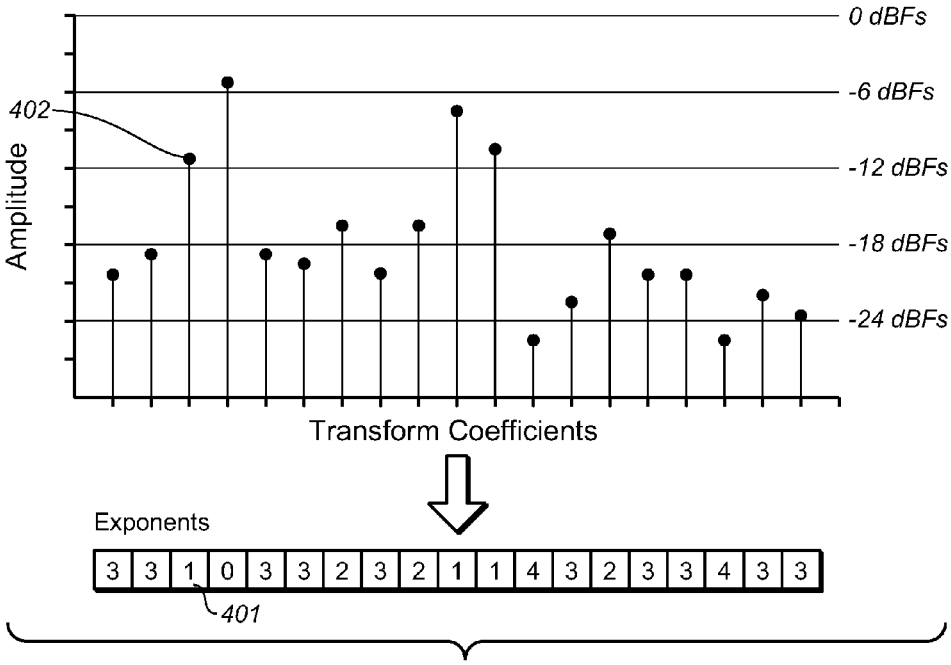
FIGS. 4A to 4E are graphs which illustrate particular aspects of an example multi-channel audio encoder.

In a first step of block floating-point encoding, raw exponents may be determined for a block of transform coefficients 312. This is illustrated in FIG. 4*a*, where a block of raw exponents 401 is illustrated for an example block of transform coefficients 402. It is assumed that a transform coefficient 402 has a value X, wherein the transform coefficient 402 may be normalized such that X is smaller or equal to 1. The value X may be represented in a mantissa/exponent format $X=m\cdot 2^{-e}$, with m being the mantissa (m<=1) (also referred to herein as a scaled value) and e being the exponent (also referred to herein as a scale factor). In an embodiment, the raw exponent 401 may take on values between 0 and 24, thereby covering a dynamic range of over 144 dB (i.e., 2(−0) to 2(−24)).

In order to further reduce the number of bits required for encoding the (raw) exponents 401, various schemes may be applied, such as time sharing of exponents across the blocks of transform coefficient 312 of a complete audio frame (typically six blocks per audio frame). Furthermore, exponents may be shared across frequencies (i.e., across adjacent frequency bins in the transform/frequency-domain). By way of example, an exponent may be shared across two or four frequency bins. In addition, the exponents of a block of transform coefficients 312 may be tented in order to ensure that the difference between adjacent exponents does not exceed a pre-determined maximum value, e.g. +/−2. This allows for an efficient differential encoding of the exponents of a block of transform coefficients 312 (e.g., using five differentials). The above mentioned schemes for reducing the data rate required for encoding the exponents (i.e., time sharing, frequency sharing, tenting and differential encoding) may be combined in different manners to define different exponent coding modes resulting in different data rates used for encoding the exponents. As a result of the above mentioned exponent coding, a sequence of encoded exponents 313 is obtained for the blocks of transform coefficients 312 of an audio frame (e.g., six blocks per audio frame).

As a further step of the Block Floating-Point Encoding scheme performed in unit 304, the mantissas m' of the original transform coefficients 402 are normalized by the corresponding resulting encoded exponent e'. The resulting encoded exponent e' may be different from the above mentioned raw exponent e (due to time sharing, frequency sharing and/or tenting steps). For each transform coefficient 402 of FIG. 4*a*, the normalized mantissa m' may be determined as $X=m'\cdot 2^{-e'}$, wherein X is the value of the original transform coefficient 402. The normalized mantissas m' 314 for the blocks of the audio frame are passed to the quantization unit 306 for quantization of the mantissas 314. The quantization of the mantissas 314, i.e. the accuracy of the quantized mantissas 317, depends on the data rate which is available for the mantissa quantization. The available data rate is determined in the bit allocation unit 305.

The bit allocation process performed in unit 305 determines the number of bits which can be allocated to each of the normalized mantissas 314 in accordance with psychoacoustic principles. The bit allocation process comprises the step of determining the available bit count for quantizing the normalized mantissas of an audio frame. Furthermore, the bit allocation process determines a power spectral density (PSD) distribution and a frequency-domain masking curve (based on a psychoacoustic model) for each channel. The PSD distribution and the frequency-domain masking curve are used to determine a substantially optimal distribution of the available bits to the different normalized mantissas 314 of the audio frame.

The first step in the bit allocation process is to determine how many mantissa bits are available for encoding the normalized mantissas 314. The target data rate translates into a total number of bits which are available for encoding a current audio frame. In particular, the target data rate specifies a number k bits/s for the encoded multi-channel audio signal. Considering a frame length of T seconds, the total number of bits may be determined as T*k. The available number of mantissa bits may be determined from the total number of bits by subtracting bits that have already been used up for encoding the audio frame, such as metadata, block switch flags (for signaling detected transients and selected block lengths), coupling scale factors, exponents, etc.). The metadata may e.g. comprise information which may be used for transcoding purposes. The bit allocation process may also subtract bits that may still need to be allocated to other aspects, such as bit allocation parameters 315 (see below). As a result, the total number of available mantissa bits may be determined. The total number of available mantissa bits may then be distributed among all channels (e.g., the main channels, the LFE channel, and the coupling channel) over all (e.g., one, two, three or six) blocks of the audio frame.

Figure 4B:
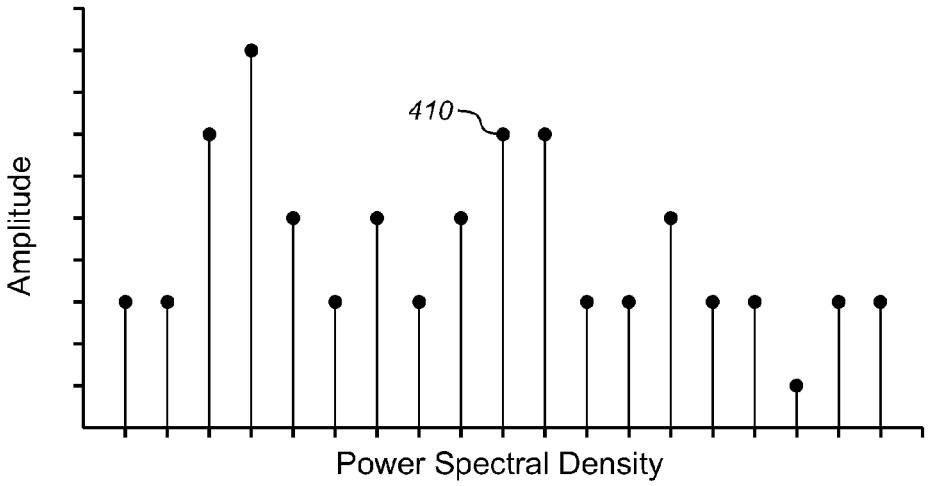
Figure 4C:
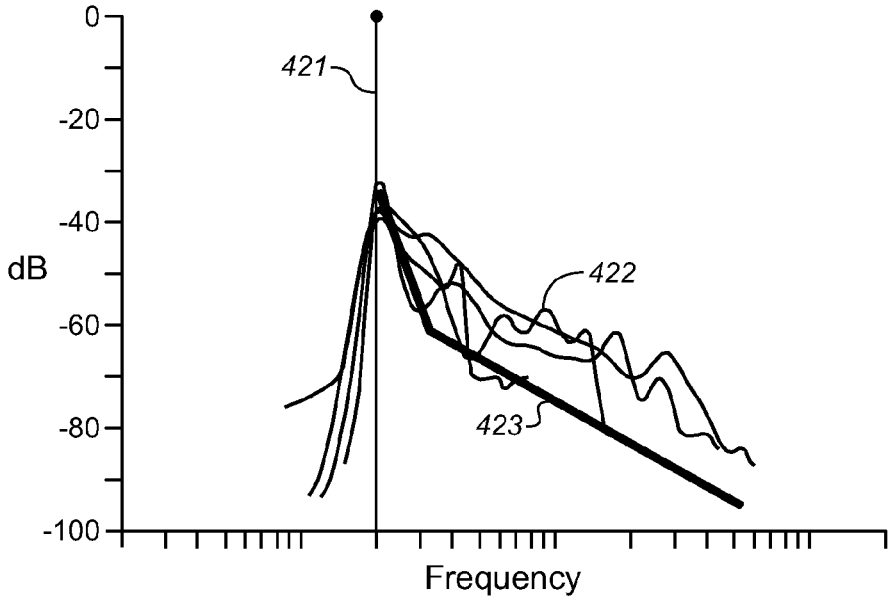

As a further step, the power spectral density ("PSD") distribution of the block of transform coefficients 312 may be determined. The PSD is a measure of the signal energy in each transform coefficient frequency bin of the input signal. The PSD may be determined based on the encoded exponents 313, thereby enabling the corresponding multi-channel audio decoder system 200, 210 to determine the PSD in the same manner as the multi-channel audio encoder 300. FIG. 4*b* illustrates the PSD distribution 410 of a block of transform coefficients 312 which has been derived from the encoded exponents 313. The PSD distribution 410 may be used to compute the frequency-domain masking curve 431 (see FIG. 4*d*) for the block of transform coefficients 312. The frequency-domain masking curve 431 takes into account psychoacoustic masking effects which describe the phenomenon that a masker frequency masks frequencies in the direct vicinity of the masker frequency, thereby rendering the frequencies in the direct vicinity of the masker frequency inaudible if their energy is below a certain masking threshold. FIG. 4*c* shows a masker frequency 421 and the masking threshold curve 422 for neighboring frequencies. The actual masking threshold curve 422 may be modeled by a (two-segment) (piecewise linear) masking template 423 used in the DD+ encoder. In FIG. 4*c*, position along the horizontal axis indicates frequency, and the values along the vertical axis are in units of dB.

Figure 4D:
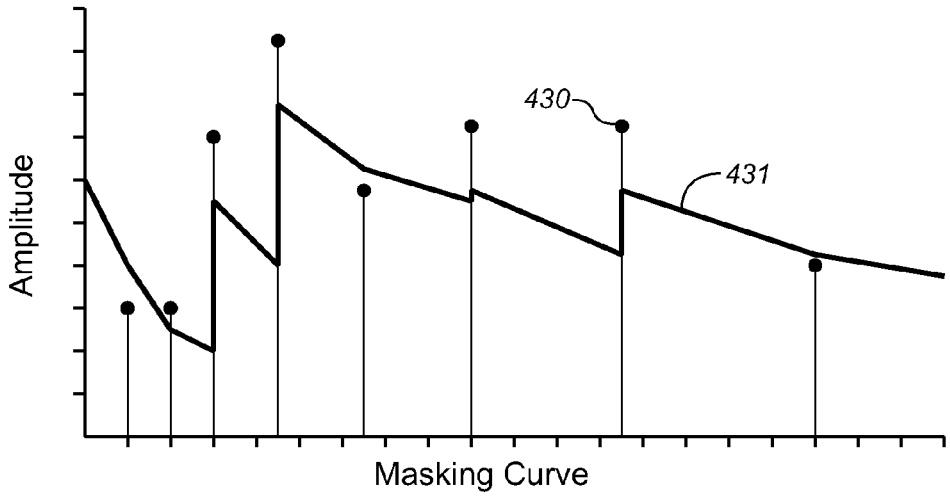

It has been observed that the shape of masking threshold curve 422 (and by consequence also the masking template 423) remains substantially unchanged for different masker frequencies on a critical band scale as defined, for example, by Zwicker (or on a logarithmic scale). Based on this observation, the DD+ encoder applies the masking template 423 onto a banded PSD distribution (wherein the banded PSD distribution corresponds to the PSD distribution on the critical band scale where the bands are approximately half critical bands wide). In case of a banded PSD distribution a single PSD value is determined for each of a plurality of bands on the critical band scale (or on the logarithmic scale). FIG. 4*d* illustrates an example banded PSD distribution 430 for the linear-spaced PSD distribution 410 of FIG. 4*b*. The banded PSD distribution 430 may be determined from the linear-spaced PSD distribution 410 by combining (e.g., using a log-add operation) PSD values from the linear-spaced PSD distribution 410 which fall within the same band on the critical band scale (or on the logarithmic scale). The masking template 423 may be applied to each PSD value of the banded PSD distribution 430, thereby yielding an overall frequency-domain masking curve 431 for the block of transform coefficients 402 on the critical band scale (or on the logarithmic scale) (see FIG. 4*d*).

Figure 4E:
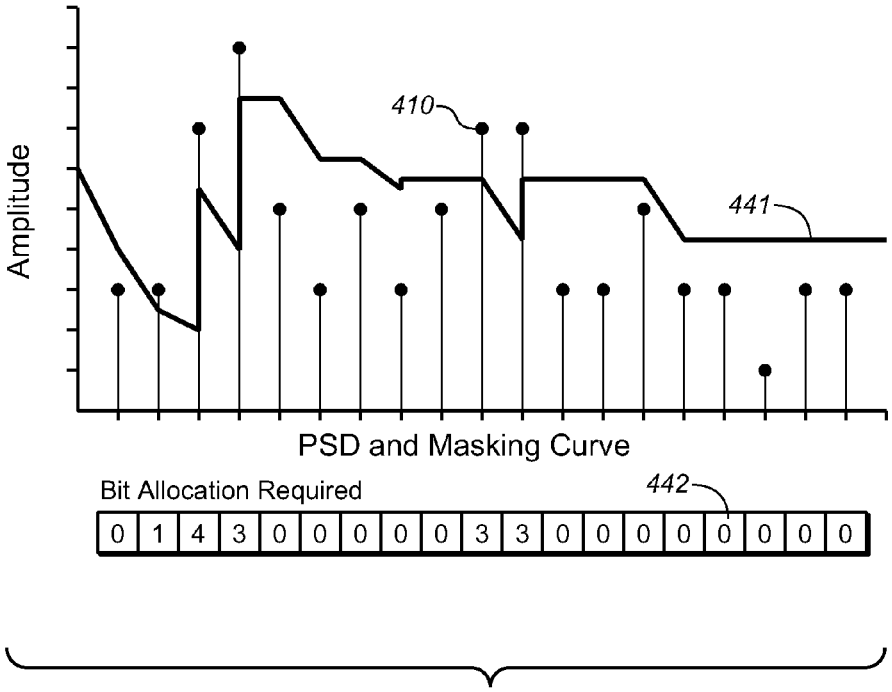

The overall frequency-domain masking curve 431 of FIG. 4*d* may be expanded back into the linear frequency resolution and may be compared to the linear PSD distribution 410 of a block of transform coefficients 402 shown in FIG. 4*b*. This is illustrated in FIG. 4*e* which shows the frequency-domain masking curve 441 on a linear resolution, as well as the PSD distribution 410 on a linear resolution. It should be noted that the frequency-domain masking curve 441 may also take into account the absolute threshold of hearing curve.

The number of bits for encoding the mantissa of the transform coefficients 402 of a particular frequency bin may be determined based on the PSD distribution 410 and based on the masking curve 441. In particular, PSD values of the PSD distribution 410 which fall below the masking curve 441 correspond to mantissas that are perceptually irrelevant (because the frequency component of the audio signal in such frequency bins is masked by a masker frequency in its vicinity). By consequence, the mantissas of such transform coefficients 402 do not need to be assigned any bits at all. On the other hand, PSD values of the PSD distribution 410 that are above the masking curve 441 indicate that the mantissas of the transform coefficients 402 in these frequency bins should be assigned bits for encoding. The number of bits assigned to such mantissas should increase with increasing difference between the PSD value of the PSD distribution 410 and the value of the masking curve 441. The above mentioned bit allocation process results in an allocation 442 of bits to the different transform coefficients 402 as shown in FIG. 4*e*.

The above mentioned bit allocation process is performed for all channels (e.g., the direct channels, the LFE channel and the coupling channel) and for all blocks of the audio frame, thereby yielding an overall (preliminary) number of allocated bits. It is unlikely that this overall preliminary number of allocated bits matches (e.g., is equal to) the total number of available mantissa bits. In some cases (e.g., for complex audio signals), the overall preliminary number of allocated bits may exceed the number of available mantissa bits (bit starvation). In other cases (e.g., in case of simple audio signals), the overall preliminary number of allocated bits may lie below the number of available mantissa bits (bit surplus). The encoder 300 typically tries to match the overall (final) number of allocated bits as close as possible to the number of available mantissa bits. For this purpose, the encoder 300 may make use of a so called SNR offset parameter. The SNR offset allows for an adjustment of the masking curve 441, by moving the masking curve 441 up or down relative to the PSD distribution 410. By moving up or down the masking curve 441, the (preliminary) number of allocated bits can be decreased or increased, respectively. As such, the SNR offset may be adjusted in an iterative manner until a termination criteria is met (e.g., the criteria that the preliminary number of allocated bits is as close as possible to (but below) the number of available bits; or the criteria that a predetermined maximum number of iterations has been performed).

As indicated above, the iterative search for an SNR offset which allows for a best match between the final number of allocated bits and the number of available bits may make use of a binary search. At each iteration, it is determined whether the preliminary number of allocated bits exceeds the number of available bits or not. Based on this determination step, the SNR offset is modified and a further iteration is performed. The binary search is configured to determine the best match (and the corresponding SNR offset) using ($\log_2(K)+1$) iterations, wherein K is the number of possible SNR offsets. After termination of the iterative search a final number of allocated bits is obtained (which typically corresponds to one of the previously determined preliminary numbers of allocated bits). It should be noted that the final number of allocated bits may be (slightly) lower than the number of available bits. In such cases, skip bits or fill bits may be used to fully align the final number of allocated bits to the number of available bits.

The SNR offset may be defined such that an SNR offset of zero leads to encoded mantissas which lead to an encoding condition known as "just-noticeable difference" between the original audio signal and the encoded signal. In other words, at an SNR offset of zero the encoder 300 operates in accordance with the perceptual model. A positive value of the SNR offset may move the masking curve 441 down, thereby increasing the number of allocated bits (typically without any noticeable quality improvement). A negative value of the SNR offset may move the masking curve 441 up, thereby decreasing the number of allocated bits (and thereby typically increasing the audible quantization noise). The SNR offset may be a 10-bit parameter with a valid range from −48 to +144 dB. In order to find the optimum SNR offset value, the encoder 300 may perform an iterative binary search. The iterative binary search may then require up to 11 iterations (in case of a 10-bit parameter) of PSD distribution 410/masking curve 441 comparisons. The actually used SNR offset value may be transmitted as a bit allocation parameter 315 to the corresponding decoder. Furthermore, the mantissas are encoded in accordance with the (final) allocated bits, thereby yielding a set of quantized mantissas 317.

In case of the DD and the DD+ audio codec system, for each block there may be a 6 bit coarse SNR offset called csnroffset and for each channel there may be a 4 bit fine SNR offset value called fsnroffset. The csnroffset value may be the same for all blocks of a frame and an fsnroffset value may be provided for each channel of a frame (and the fsnoffset value for a channel may be the same for all blocks of the frame for the channel). In the DD+ audio codec system, it may be selected to transmit the parameters csnroffset and fsnroffset only once per frame as a 6 bit formcsnroffset and a 4 bit formfsnroffset parameter.

As outlined in the present document, in the DD+ audio codec system the convsnroffset parameter may be provided. The convsnroffset parameter is typically not split into two parts, but the convsnroffset is typically a 10 bit value for each audio block within the DD+ bitstream. Hence, if the convsnroffset parameter is determined based on the csnroffset and fsnroffset parameters (as described in the present document), the convsnroffset parameter may be determined by combining the 6 bit csnroffset and the 4 bit fsnroffset into a single value.

As such, the SNR (Signal-to-Noise-Ratio) offset parameter may be used as an indicator of the coding quality of the encoded multi-channel audio signal. According to the above mentioned convention of the SNR offset, an SNR offset of zero indicates an encoded multi-channel audio signal having a "just-noticeable difference" to the original multi-channel audio signal. A positive SNR offset indicates an encoded multi-channel audio signal which has a quality of at least the "just-noticeable difference" to the original multi-channel audio signal. A negative SNR offset indicates an encoded multi-channel audio signal which has a quality low than the "just-noticeable difference" to the original multi-channel audio signal. It should be noted that other conventions of the SNR offset parameter may be possible (e.g., an inverse convention).

The encoder 300 further comprises a bitstream packing unit 307 which is configured to arrange the encoded exponents 313, the quantized mantissas 317, the bit allocation parameters 315, as well as other encoding data (e.g., block switch flags, metadata, coupling scale factors, etc.) into a predetermined frame structure (e.g., the frame structure of an E-AC-3 bitstream), thereby yielding an encoded frame 318 (encoded in accordance with the DD+ codec system or another E-AC-3 codec system) in response to an audio frame of the multi-channel audio input signal. Typically, a sequence of frames 318 (each encoded in accordance with the DD+ codec system or another E-AC-3 codec system) is generated in response to a sequence of frames of the audio input signal.

Buffer memory (buffer) 325 is coupled to bitstream packing unit 307. In operation, buffer 325 stores (e.g., in a non-transitory manner) data indicative of each encoded frame 318. Encoder 300 is coupled and configured to assert to delivery system 600 a signal indicative of a first bitstream. The first bitstream is indicative of frame 318, or of each frame of a sequence of E-AC-3 frames 318, generated by encoder 300 and buffered in buffer 325.

Delivery system 600 is configured to store the signal (or to store data indicated by the signal) and/or to transmit the signal to transcoder 700.

Transcoder 700 is coupled and configured (e.g., programmed) to receive the signal (or data indicated by the signal) from system 600 (e.g., by reading or retrieving the data from storage in system 600, or receiving the signal that has been transmitted by system 600). Buffer 701 of transcoder 700 stores (e.g., in a non-transitory manner) data indicative of each E-AC-3 frame 318 of the first bitstream delivered to transcoder 700 by system 600. Transcoding subsystem 702 of transcoder 700 is coupled and configured to decode the first bitstream to generate decoded data (including de-quantized mantissas and exponents of audio content of each E-AC-3 frame of the first bitstream, and a second control parameter generated in accordance with an embodiment of the invention for each such E-AC-3 frame and included by encoder 300 in the first bitstream), and to re-encode the decoded data at a second target data rate in accordance with the AC-3 codec system to generate a second bitstream indicative of re-encoded audio content (including exponents and re-quantized mantissas). More specifically, subsystem 701 is configured to use the second control parameter (generated in accordance with an embodiment of the invention) for each E-AC-3 frame to re-encode the audio content of the frame in accordance with the AC-3 codec system at a second target data rate. The output of subsystem 703 is second bitstream indicative of an AC-3 frame (generated at the second target data rate in response to each E-AC-3 frame of the first bitstream delivered to transcoder 700), or indicative of a sequence of AC-3 frames (each generated in response to an E-AC-3 frame of a sequence of E-AC-3 frames of the first bitstream delivered to transcoder 700).

As indicated above, the encoder 100 (or 300) may be configured to determine one or more control parameters which enable a transcoder to transcode an encoded frame 318 which has been encoded in accordance with a first audio codec system (e.g. DD+) into a modified frame which may be decoded by a decoder of a second audio codec system (e.g. DD). For this purpose, the encoder 100 (or 300) may be configured to simulate an audio encoder which operates in accordance with the second audio codec system and thereby determine the control parameters.

Figure 3:
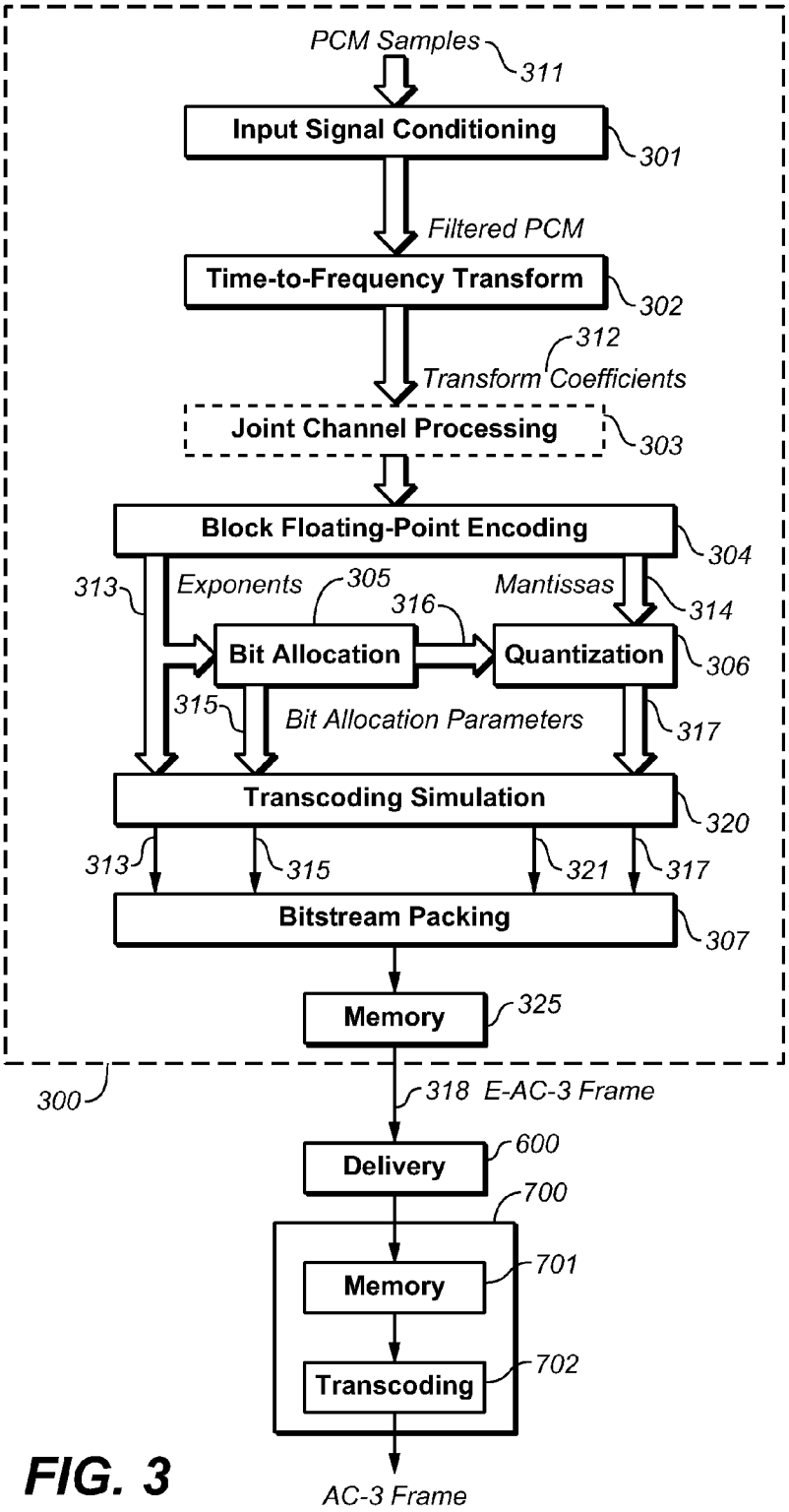
FIG. 3 is a block diagram of components of an example multi-channel audio encoder (300), a delivery system (600) coupled thereto, and a transcoder (700) coupled to the delivery system.

This is illustrated in the encoder 300 of FIG. 3 which comprises a transcoding simulation unit 320. The transcoding simulation unit 320 may receive the encoded exponents 313, the quantized mantissas 317 and the one or more bit allocation parameters 315 used by the encoder 300 to encode a frame of an audio signal in accordance with the first audio codec system. Furthermore, the transcoding simulation unit 320 may be configured to simulate the functions of a transcoder (e.g., to de-quantize the quantized mantissas 317 and re-quantize the de-quantized mantissas 317 in accordance with the second audio codec system). In particular, the transcoding simulation unit 320 may be configured to determine second control parameters 321 (e.g., one or more second bit allocation parameters) which may be transmitted to a transcoder (e.g., transcoder 700) to reduce the computational complexity of transcoding (by the transcoder) of the type simulated by unit 320.

By way of example, a DD+ encoder is typically configured to determine a so called convsnroffset parameter (i.e. a control parameter) which enables a converter (e.g., transcoder) to convert the DD+ bitstream (comprising a plurality of encoded frames 318) into a 640 kbps DD bitstream. The convsnroffset parameter may also be referred to as the conversion SNR offset parameter or more generically as a control parameter. The calculation of the convsnroffset parameter may be performed in the context of the DD+ encoding process, in order to help reduce the complexity of a conversion to the DD format in the converter (e.g., transcoder). The calculation of the convsnroffset parameter typically requires partial decoding of the DD+ bitstream and the simulation of a 640 kbps DD encoding by the encoder 100, 300. This leads to a significant computational complexity, as the encoder 100, 300 has to perform the encoding process described in the context of FIGS. 3 and 4*a* to 4*e* not only for the DD+ encoder, but also for a DD encoder. The convsnroffset parameter typically corresponds to the above mentioned SNR offset derived for a DD encoder operating at a target bit rate of 640 kb/s. In the present document, methods and systems are described which allow to reduce the computational complexity for determining the convsnroffset parameter. Furthermore, the described methods and systems may allow reduction of the computational complexity of performing transcoding from a DD+ bitstream to a DD bitstream.

DD+ encoder 300 may make use of coding tools to reduce the bit rate of an encoded audio signal (at a given quality) or to increase the quality of the encoded audio signal (at a given bit rate). Examples of such coding tools are the use of AHT (Adaptive Hybrid Transform), the use of ECPL (Enhanced Coupling), the use of SPX (Spectral Extension) and/or the use of TPNP (Temporal Pre-Noise Processing). A variant of a DD+ encoder (sometimes referred to as a Low complexity DD+ or "LC DD+" encoder), typically used in conjunction with computing devices having a limited computational complexity such as mobile devices), does not make use of all the above mentioned DD+ coding tools. As such, an LC DD+ encoder is similar to or corresponds to a DD encoder that encodes the encoded exponents, the quantized mantissas, the bit allocation parameter, etc. into a DD+ bitstream format which typically differs from the DD bitstream format. As such, it has been observed that there is a significant overlap between an LC DD+ encoder and a DD encoder. This overlap or similarity can be used to reduce the computational complexity for determining the convsnroffset parameter.

As indicative above, a typical DD+ encoder 300 determines the convsnroffset parameter, in order to enable an efficient conversion of a DD+ bitstream into a 640 kbps DD bitstream at a transcoder. By inserting the convsnroffset parameter into the DD+ bitstream, the transcoder does not have to perform the above mentioned iterative bit allocation process (comprising e.g. 11 iterations), as it can directly re-quantize the mantissas using a quantizer having a resolution given by the convsnroffset parameter. As such, the complex SNR offset calculation for a DD bitstream is moved from the converter/transcoder to the encoder and the result is transmitted as the convsnroffset parameter within the DD+ bitstream. The calculation of the convsnroffset parameter (performed within a so-called stuffer) in the encoder 300 requires about 25-40% of the total DD+ encoder complexity. Hence, it is desirable to reduce the complexity for calculating the convsnroffset parameter.

In the present document, a simplified stuffer is described which allows determination of the convsnroffset parameter at a reduced complexity. As outlined above, there typically is a large overlap between the DD+ encoder and the DD encoder. In particular, there is a large overlap with regards to the floating-point encoding described in the context of FIGS. 3 and 4*a* to 4*e*. This is particularly true for a low complexity (LC) DD+ encoder, where the only difference between the DD encoder and the LC DD+ encoder may be the bitstream format. The scheme for determining the exponents and mantissas, and the schemes for encoding the exponents and for quantizing the mantissas are typically the same. Hence, it may be possible to re-use the DD+ SNR offset for the stuffer and convert the DD+ bitstream into a DD bitstream using the same SNR offset parameter. In other words, it may be possible to reuse the SNR offset parameter (which is used in the context of the DD+ codec) as the convsnroffset parameter, thereby rendering an explicit convsnroffset parameter calculation obsolete, and thereby significantly reducing the computational complexity of an (LC) DD+ encoder.

Furthermore, the re-use of the SNR offset parameter as the convsnroffset parameter may be beneficial with regards to the audio quality of the transcoded DD encoded audio signal. In particular, the transcoder may not impact the audio quality since the original DD+ representation is maintained. In particular, in cases where the DD+ target bit rate corresponds to the DD target bit rate, i.e. in cases where the target bit rates of the DD+ bitstream and of the DD bitstream are the same (e.g. 640 kbps), the transcoder may be configured to reuse the exponents and/or quantized mantissas from the DD+ bitstream for generating the DD bitstream. As a result, the audio quality of the audio signal comprised within the DD+ bitstream and the audio quality of the audio signal comprised within the DD bitstream are the same. Furthermore, the complexity of the transcoder is reduced, as the transcoder does not need to de-quantize and re-quantize the mantissas when generating the DD bitstream.

Figure 5:
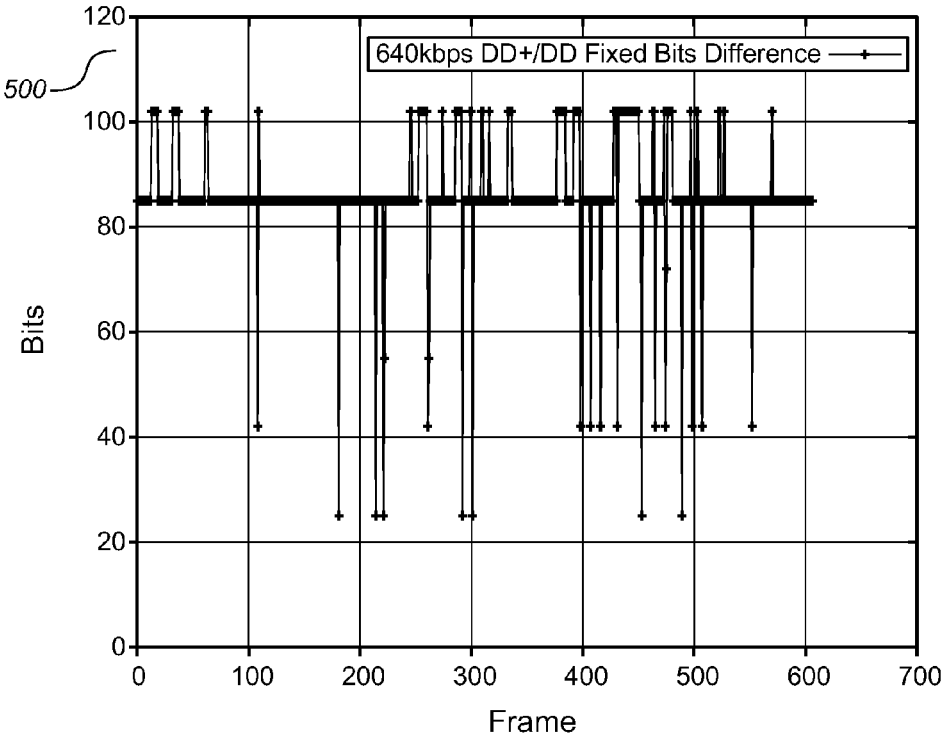
FIG. 5 is a graph of the number of fixed bits used for the DD+ bitstream format and for the DD bitstream format for a plurality of example frames.

As indicated above, an LC DD+ encoder may be viewed as a DD encoder which encodes the encoded exponents, the quantized mantissas, etc. into a DD+ bitstream format. The DD+ bitstream format typically differs from the DD bitstream format. In particular, the amount of fixed bits (for synchronization information (si); bitstream information (bsi); audio frame (audform); auxiliary data (auxdata); errorcheck; exponents; etc.) for the DD bitstream format is typically larger compared to the DD+ bitstream format. This can be seen in FIG. 5 where the difference 500 between the number of fixed bits used in the DD+ bitstream format and the DD bitstream format is illustrated for a plurality of frames. It can be seen that the DD bitstream format requires in average about 80 to 100 fixed bits more than the DD+ bitstream format. Consequently, if using the DD+ SNR offset for generating the DD bitstream would yield to a bitstream that requires more bits than available in a 640 kbps frame size (640 kbps=20480 bits/frame). In other words, when using the SNR offset parameter determined for DD+ as the convsnroffset parameter, this would lead to a DD bitstream which slightly exceeds the target bit rate of 640 kbit/s. This, however, is usually not acceptable, as the transcoder typically provides a fixed frame size of 20480 bits/frame, i.e. a fixed frame size which corresponds to the target bit rate.

Different approaches may be used to overcome this issue, wherein the approaches depend on the DD+ target bit rate. In the case of a DD+ target bit rate of 640 kbits/s, i.e. in the case of a DD+ target bit rate which corresponds to the DD target bit rate, the above mentioned issue may be overcome by taking into account the DD/DD+ fixed bits difference in the context of the bit allocation process of the DD+ encoder 300. As outlined above, the iterative bit allocation process starts with determining a total number of available mantissa bits, i.e. a total number of bits which may be allocated to the quantization of the mantissas. It is proposed in the present document to subtract the DD/DD+ fixed bits difference from the DD+ specific total number of available mantissa bits, thereby yielding a reduced total number of available mantissa bits which takes into account the possible transcoding to DD. The DD/DD+ fixed bits difference which is subtracted may be determined in a frame specific manner or it may correspond to an average or worst case value. The DD+ SNR offset calculation may then be performed using the reduced total number of available mantissa bits.

As a result, the quality of the DD+ encoded audio signal is slightly reduced. The impact on the audio quality is, however, low, due to the fact that the observed worst case penalty is in the range of 102 bits of DD/DD+ fixed bits difference per frame which corresponds to a bit rate of 3 kbps or 0.5% of the total DD+ target bit rate. As indicated above, the bits which are not used within the DD+ bitstream due to the reduced total number of available mantissa bits may be filled with skip bits or fill bits, thereby yielding DD+ compatible frames at the DD+ target bit rate of 640 kbits/s.

As a further result, the SNR offset which has been calculated in the context of the DD+ encoding process can now be used as the convsnroffset parameter. It is now ensured that the transcoded DD bitstream meets the DD target bit rate of 640 kbps.

As a further benefit, the complexity of the converter (e.g., transcoder) can be reduced. The converter may copy the DD+ encoded exponents and the DD+ quantized mantissas into a DD bitstream, without the need of a performing a partial DD+ decode and a DD re-encode.

Another approach may be taken in a situation where the DD+ target bit rate is smaller than the DD target bit rate. By way of example, the DD+ target bit rate may be 448 kbps or 384 kbps. The converter is typically limited to only one DD target bit rate (e.g. 640 kbps) such that the reduced DD+ target bit rates are not available. Nevertheless, the SNR offset determined in the context of the DD+ encoding may be re-used as the convsnroffset parameter. This is possible due to the fact that in any case the quality of the DD+ encoded audio signal is limited by the DD+ target bit rate. A transcoding of a DD+ encoded audio signal which has been encoded at a DD+ target bit rate which is lower than the DD target bit rate cannot provide a DD encoded audio signal which has an audio quality higher than the DD+ encoded audio signal.

However, the DD+ encoder which is operated at a relatively low DD+ target bit rate may make use of coding tools which are not used by the DD encoder. As such, the impact of these coding tools should be taken into account. If the DD+ encoder provides encoded exponents and quantized mantissas of full channels, these full channels (i.e. the encoded exponents and quantized mantissas) can be copied into the DD bitstream, thereby improving the audio quality (i.e. the Signal to Noise Ratio) compared to conventional transcoders, as the steps of DD+ decoding and DD re-encoding become obsolete.

If the DD+ encoder provides one or more coupling channels (typically, DD and DD+ encoder provide only a single coupling channel), the coupling channels typically need to be decoded and re-encoded individually as full channels within the DD bitstream, because the DD encoder at the DD target bit rate (of 640 kbps) typically does not make use of coupling. This transcoding may lead to a quality loss of the DD encoded audio signal compared to the DD+ encoded audio signal (due to the DD+ decoding and the DD re-encoding operations). Furthermore, the DD encoding of a plurality of full channels typically requires an increased amount of bits compared to the DD+ encoding of a reduced number of coupling channels. By way of example, all the five channels of a 5.1 multichannel audio signal may have been coupled, which leads to the situation that a single original coupling channel needs to be encoded five times by the DD encoder. The additional bits which are needed for encoding an original coupling channel multiple times (e.g. five times) may be compensated by a smaller bit demand for full channels (compared to the bit demand for coupling channels).

Figure 6:
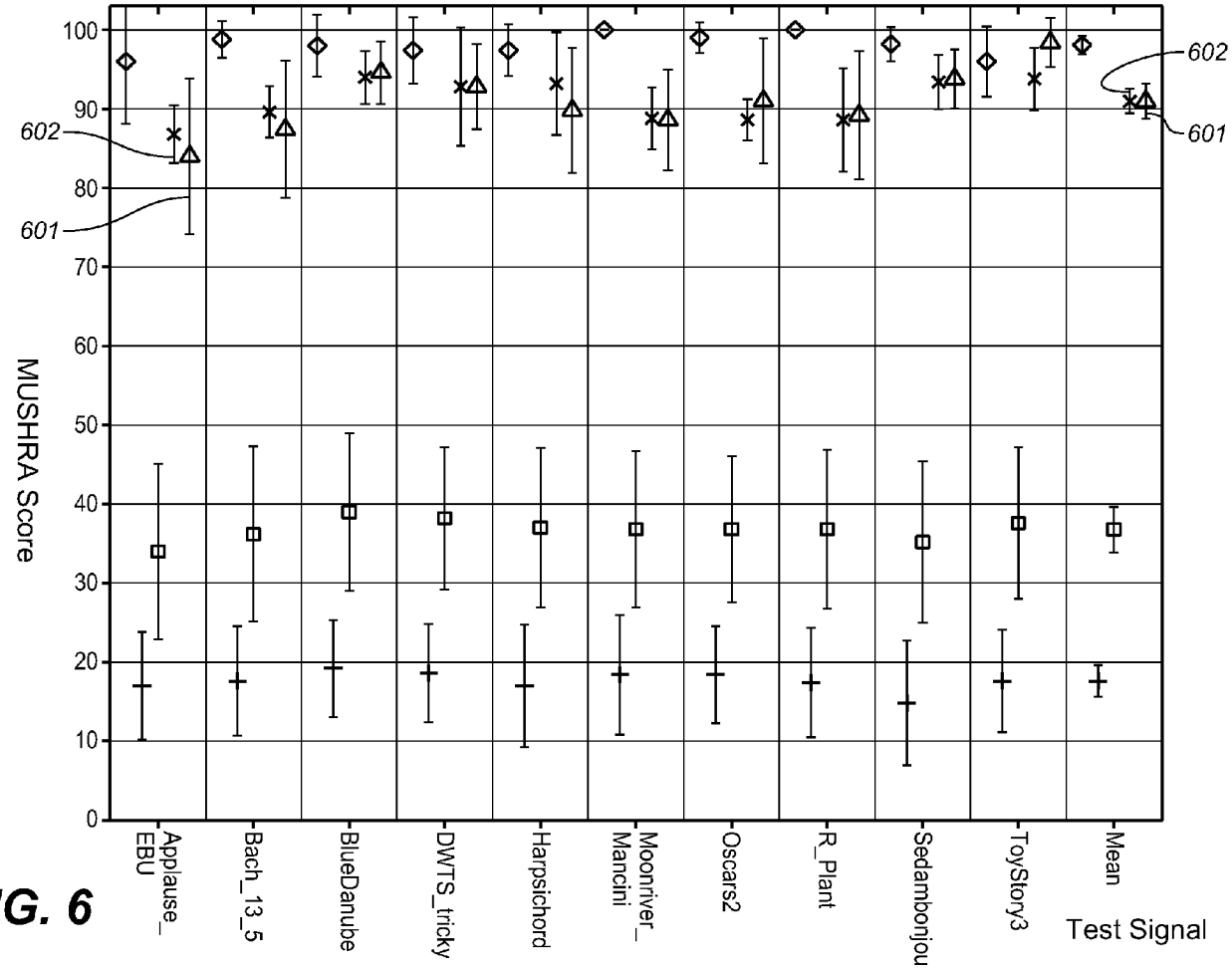
FIG. 6 is a graph of example experimental results of listening tests.

FIG. 6 illustrates example MUSHRA (MUltiple Stimuli with Hidden Reference and Anchor) tests where the audio quality of a plurality of different audio signals is analyzed. In FIG. 6, different test signals are identified along the horizontal axis, and the values along the vertical axis are MUSHRA scores. In particular, the audio quality 601 of a transcoded signal (a transcoded version of the corresponding test signal) which has been transcoded using the explicitly calculated convsnroffset parameter is compared with the audio quality 602 of a transcoded signal (another transcoded version of the corresponding test signal) which has been transcoded using an convsnroffset parameter which corresponds to the SNR offset of the DD+ encoded audio signal. In the illustrated example, the DD+ target bit rate is 384 kbps and the DD target bit rate is 640 kbps. In the illustrated example, the DD+ encoder 300 makes use of coupling (with a coupling begin frequency at around 10 kHz). It can be observed that for the illustrated plurality of different audio signals, no significant quality degradation can be observed. On the other hand, the computational complexity at the encoder 300 and possibly the computational complexity at the converter have been significantly reduced.

It should be noted that the bit rate of the converted (i.e. transcoded) bitstream may exceed the DD target bit rate (e.g. of 640 kbps). This could occur for the 640 kbps DD+ case (i.e. for the case where the DD+ target bit rate corresponds to the DD target bit rate), if the worst-case DD+/DD fixed bit difference is not determined correctly (i.e. is assumed to be too low). Alternatively or in addition, this could occur for lower data rates (i.e. for the case where the DD+ target bit rate is lower than the DD target bit rate), if the one or more expanded coupling channels require more bits than available in the conversion.

The encoder 300 may be configured to detect the above mentioned situation, where the converted DD bitstream would exceed the DD target bit rate, if the DD+SNR offset is used as the convsnroffset parameter. In particular, the DD+ encoder 300 may be configured to validate the DD+SNR offset for the converted DD bitstream with a single bit allocation iteration (compared to 11 iterations needed for an explicit determination of the convsnroffset parameter). This could be verified on a frame by frame basis.

If it is determined that (for a particular frame) using the DD+SNR offset as the convsnroffset parameter would lead to a number of bits exceeding the DD target bit rate, the encoder 300 could apply one or more recovery strategies: By way of example, the encoder 300 could be configured to perform an explicit convsnroffset calculation as a fallback. The DD+ SNR offset could be used as an improved starting point, thereby potentially reducing the number of required iterations. Alternatively or in addition, an empirical analysis could be used to determine an initial SNR offset based on the DD+ SNR Offset, wherein the initial SNR offset reduces (e.g. minimizes) the number of bit allocation iterations. Alternatively or in addition, the explicit convsnroffset calculation may be used, but the iterative process may be stopped when an intermediate result is obtained which is considered to be good enough (e.g. which leads to a quantization noise which is 6 dB below the masking threshold).

In the present document, it has been proposed to copy the SNR offset value of DD+ to the convsnroffset value which is used for DD encoding at a converter. This approach is particularly relevant for an LC DD+ encoder operating at 640 kbps, because the LC DD+ encoder does not use any of the DD+ tools or coupling for this target bit rate. For lower bitrates, the LC DD+ encoder typically uses coupling. Nevertheless, the DD+SNR offset value can be used for the convsnroffset value with only a small potential degradation of audio quality.

As outlined above, the 640 kbps DD format typically needs more bits to store the side information than the 640 kpbs DD+ format. It is proposed in the present document to consider the bit difference during the DD+ encoding process. The maximum amount of lost bit rate for DD+ has been measured to be 3 kbps or 0.5% of the total bit rate, which does not result in an audible degradation of the DD+ bitstream. However, by taking into account the bit difference during DD+ encoding, it is possible to use the same SNR offset for the DD+ encoding as well as for the DD+ to DD transcoding. The resulting decoder output of the DD+ bitstream and of the transcoded DD bitstream are typically the same except for the different dithering applied by a DD+ decoder and by a DD decoder.

For lower bit rates (e.g. 448 kbps and 384 kbps) of the LC DD+ encoder, coupling is typically used by the LC DD+ encoder. The converter typically converts the DD+ bitstream to a 640 kbps DD bitstream without coupling. A listening test shows that using the DD+ SNR offset for the converter (i.e. setting convsnroffset equal to DD+ SNR offset) yields an audio quality of the transcoded signal which is comparable to the audio quality of the transcoded signal which has been derived by a converter using an explicitly calculated convsnroffset parameter. The experimental results have also shown that the increase in bits caused by the encoding of the coupling channels as full channels typically does not exceeds the limit set by the DD target bit rate (of e.g. 640 kbps).

The DD+ encoder may be configured to determine whether the DD+ SNR offset is invalid for the converted DD bitstream (i.e., whether there are an exceeding number of bits when using the DD+ SNR offset within the converter for generating the DD bitstream). If this is the case, it is possible to use the explicit converter snroffset (i.e., convsnroffset) parameter calculation as a fallback for the specific frame for which such a bit overflow occurs. Nevertheless, it may be possible to reduce the computational complexity by using the DD+ snroffset value as a better starting point for the convsnroffset parameter calculation or/and by stopping the iteration prior to finding the optimum result, e.g. when an intermediate result already meets pre-determined quality criteria.

We next describe a second class of embodiments in which an E-AC-3 encoder (an encoder configured to generate a first bitstream having E-AC-3 format, at a first target data rate) is configured to determine in an especially efficient manner (to be described below) a "converter snroffset" parameter (an example of the second control parameter described herein) for each segment (e.g., frame) of an audio signal, and to determine an "SNR offset" parameter (an example of the first control parameter described herein) for said each segment of the audio signal. The "converter snroffset" parameter is sometimes referred to herein as a "convsnroffset" value or parameter or a "converter SNR offset" value or parameter. The "SNR offset" parameter is sometimes referred to herein as a "DD+ SNR offset" parameter or value (when the encoder is configured to generate the bitstream to have DD+ format) or as an "snroffset" value or parameter. Embodiments in the second class contemplate that the first bitstream is indicative of encoded audio content including quantized mantissas, and that a converter (e.g., transcoder) may decode the first bitstream to generate decoded data including de-quantized mantissas and re-encode the decoded data at a second target data rate in accordance with the AC-3 codec system to generate a second bitstream indicative of re-encoded audio content including re-quantized mantissas.

An example of an embodiment in the second class is an implementation of multi-channel encoder 300 (of FIG. 3) in which transcoding simulation unit 320 is configured to generate the converter snroffset parameter (second control parameter) in the especially efficient manner. In this embodiment, a subsystem (e.g., bit allocation unit 305) of the encoder is configured to execute an iterative bit allocation process (sometimes referred to herein as a "main" bit allocation process) in accordance with the E-AC-3 codec system) assuming a first target data rate of the E-AC-3 encoded bitstream to be generated by the encoder, to generate the SNR offset parameter (the first control parameter) for each segment (e.g., frame) of the audio signal. Another subsystem (sometimes referred to herein as a "sniffer") of the encoder (e.g., a stuffer subsystem of simulation unit 320) is configured to execute a second iterative bit allocation process (in accordance with the AC-3 codec system), assuming the second target data rate, to generate the "converter snroffset" parameter (the second control parameter) for each segment (e.g., frame) of the audio signal. The stuffer is configured to execute the second iterative bit allocation process to determine the second control parameter to be indicative of an allocation of available bits for quantizing the de-quantized mantissas to generate (in the contemplated converter) the re-quantized mantissas during generation (in the contemplated converter) of the second bitstream at the second target data rate, such that each bit allocation iteration of the second iterative bit allocation process assumes a candidate allocation of available bits determined by a different candidate second control parameter of a set of candidate second control parameters, where the set of candidate second control parameters has been predetermined by statistical analysis of results of bit allocation processing of audio data in accordance with the E-AC-3 codec system assuming the first target data rate, and results of bit allocation processing of the audio data in accordance with the AC-3 codec system assuming the second target data rate. The encoder (i.e., packing unit 307 of encoder 300) is configured to include the second control parameter for each segment (e.g., each frame) in the E-AC-3 bitstream output from the encoder, for use by the converter in generation of the AC-3 bitstream (at the second target data rate) in response to the E-AC-3 bitstream.

Typically, the main bit allocation process which generates the SNR offset parameter (first control parameter) implements an expensive (high processing cost) iterative binary search which can require up to 10 iterations, and the "converter snroffset" parameter (second control parameter) is a 10-bit value (i.e., a value in the range 0-1024). In typical implementations, the second target data rate is 640 Kbps (so that the stuffer runs at a fixed data rate of 640 Kbps), whereas the first target data rate (assumed by the main bit allocation process) can have any of a variety of different values (e.g., 384 Kbps, 448 Kbps, 640 Kbps, 768 Kbps, or some other rate).

In typical embodiments in the second class, the second target data rate is at least substantially equal to 640 Kbps, and the "converter snroffset" parameter (second control parameter) for a segment (e.g., frame) of the audio content is generated, using the first control parameter (i.e., the SNR offset parameter) determined for the segment, as follows:

when the first target data rate (assumed by the main bit allocation process) is at least substantially equal to 640 Kbps, the stuffer is seeded with the first control parameter (SNR offset parameter), in the sense that the first control parameter is employed as a candidate value (e.g., the initial candidate value) of the second control parameter, and the second iterative bit allocation process (performed by the stuffer) iterates (typically linearly) for no more than a predetermined number of iterations (e.g., two or three iterations, or another small number of iterations) to determine the final value of the second control parameter, where the predetermined number of iterations has been predetermined (preferably from statistical analysis of results of bit allocation processing of audio data in accordance with the E-AC-3 codec system assuming the first target data rate, and results of bit allocation processing of the audio data in accordance with the AC-3 codec system assuming the second target data rate) to be the minimum number of iterations expected to be necessary to determine a final value of the second control parameter with a predetermined degree of confidence. Thus, each bit allocation iteration of the second iterative bit allocation process assumes a candidate allocation of available bits determined by a different candidate second control parameter of a predetermined set of candidate second control parameters (i.e., the predetermined set of candidate second control parameters includes the first control parameter, the initial candidate second control parameter is the first control parameter, and each candidate second control parameter used in a subsequent iteration is a member of the predetermined set of candidate second control parameters which is an incremented version of the initial candidate second control parameter); and when the first target data rate (assumed by the main bit allocation process) is not equal to 640 Kbps (typically, the first target rate is not equal to 640 Kbps and is not substantially equal to 640 Kbps), a predetermined initial candidate value of the second control parameter is employed as an initial candidate value of the second control parameter, and the second iterative bit allocation process (performed by the stuffer) iterates for no more than a predetermined number of iterations to determine the final value of the second control parameter, where the predetermined number of iterations and the predetermined initial candidate value of the second control parameter have been predetermined (preferably from statistical analysis of results of bit allocation processing of audio data in accordance with the E-AC-3 codec system assuming the first target data rate, and results of bit allocation processing of the audio data in accordance with the AC-3 codec system assuming the second target data rate) to be the minimum number of iterations (starting with the predetermined initial candidate value of the second control parameter)

expected to be necessary to determine a final value of the second control parameter with a predetermined degree of confidence. Each bit allocation iteration of the second iterative bit allocation process assumes a candidate allocation of available bits determined by a different candidate second control parameter of a predetermined set of candidate second control parameters. Typically, the predetermined initial candidate value of the second control parameter is one endpoint of a predetermined confidence interval (which has been predetermined from at least one statistical distribution generated during the statistical analysis, and includes the predetermined set of candidate second control parameters). In some implementations of the second iterative bit allocation process, the predetermined initial candidate value may be incremented by a predetermined increment value (e.g., a predetermined increment value equal to one) during each iteration. In other implementations (e.g., in a binary search implementation of the second iterative bit allocation process), the candidate value for an iteration may be chosen in another way.

In other embodiments in the second class, the second target data rate is equal to R, where R need not be equal to 640 Kbps (and may be very different than 640 Kbps). In these embodiments:

when the first target data rate (assumed by the main bit allocation process) is at least substantially equal to R, the stuffer is seeded with the first control parameter (SNR offset parameter), in the sense that the first control parameter is employed as a candidate value (e.g., the initial candidate value) of the second control parameter, and the second iterative bit allocation process (performed by the stuffer) iterates (typically linearly) for no more than a predetermined number of iterations (e.g., two or three iterations, or another small number of iterations) to determine the final value of the second control parameter, where the predetermined number of iterations has been predetermined (preferably from statistical analysis of results of bit allocation processing of audio data in accordance with the E-AC-3 codec system assuming the first target data rate, and results of bit allocation processing of the audio data in accordance with the AC-3 codec system assuming the second target data rate) to be the minimum number of iterations expected to be necessary to determine a final value of the second control parameter with a predetermined degree of confidence. Thus, each bit allocation iteration of the second iterative bit allocation process assumes a candidate allocation of available bits determined by a different candidate second control parameter of a predetermined set of candidate second control parameters (i.e., the predetermined set of candidate second control parameters includes the first control parameter, one candidate second control parameter is the first control parameter, and each candidate second control parameter used in a subsequent iteration is a member of the predetermined set of candidate second control parameters which is an incremented version of the initial candidate second control parameter); and when the first target data rate (assumed by the main bit allocation process) is not equal to R (typically, the first target rate is not equal to R and is not substantially equal to R), a predetermined initial candidate value of the second control parameter is employed as an initial candidate value of the second control parameter, and the second iterative bit allocation process (performed by the stuffer) iterates for no more than a predetermined number of iterations to determine the final value of the second control parameter, where the predetermined number of iterations and the predetermined initial candidate value of the second control parameter have been predetermined (preferably from statistical analysis of results of bit allocation processing of audio data in accordance with the E-AC-3 codec system assuming the first target data rate, and results of bit allocation processing of the audio data in accordance with the AC-3 codec system assuming the second target data rate) to be the minimum number of iterations (starting with the predetermined initial candidate value of the second control parameter) expected to be necessary to determine a final value of the second control parameter with a predetermined degree of confidence. Each bit allocation iteration of the second iterative bit allocation process assumes a candidate allocation of available bits determined by a different candidate second control parameter of a predetermined set of candidate second control parameters. Typically, the predetermined initial candidate value of the second control parameter is one endpoint of a predetermined confidence interval (which has been predetermined from at least one statistical distribution generated during the statistical analysis, and includes the predetermined set of candidate second control parameters).

In various implementations of embodiments in the second class, the main bit allocation process and the second iterative bit allocation process are performed in any of the ways described herein with reference to other embodiments of the present invention, except that: the initial candidate value of the second control parameter in the second iterative bit allocation process (in embodiments in the second class) may differ from that employed in such other embodiments; the candidate value of the second control parameter in each iteration of the second iterative bit allocation process (in embodiments in the second class) may differ from that employed in corresponding iterations of such other embodiments; and the predetermined number of iterations for the second iterative bit allocation process (in embodiments in the second class) is typically smaller than the number of iterations employed in the other embodiments to generate a second control parameter.

With reference to FIG. 7, we next describe a typical embodiment in the second class in which an E-AC-3 encoder (an implementation of DD+ encoder 300) is configured to operate at a first target data rate of 640 Kbps to generate the second control parameter (the converter SNR offset parameter), and the second target data rate is also equal to 640 Kbps. FIG. 7 is a table of data generated by analyzing results of operation of the encoder (running at 640 Kbps) to encode a sequence of N frames of audio data, where N is a very large number (i.e., N is greater than 97,000). For each of the frames (i.e., for the "i"th frame, where i is an index in a range from 1 through N), an iterative bit allocation process (in accordance with the E-AC-3 codec system) is performed (in bit allocation unit 305) to determine an SNR offset value (the first control parameter) for the frame, and a second iterative bit allocation process (in accordance with the AC-3 codec system) is performed (in simulation unit 320) to generate a converter SNR offset parameter (the second control parameter) for the frame.

In FIG. 7, the first column (labeled "SNR offset difference") indicates values of the difference between the two determined values (B−A, where A is the first control parameter determined for a frame and B is the second control parameter determined for the same frame) for each frame, and each row of the second column (labeled "Frequency") indicates the number of frames for which the SNR offset difference (the difference value, B−A) is as indicated in the corresponding row of the first column. For example, for 50,223 of the frames the determined first control parameter was identical to the second control parameter B−A=0), and for 40,676 of the frames the determined second control parameter was one less than the determined first control parameter (B−A=−1).

Each row of the third column in FIG. 7 (labeled "Cumulative %") indicates the cumulative percentage of the frames for which the difference value (B−A) was greater than or equal to the difference value (B−A) in the same row of the first column. For example, for 51.52% of the frames, the difference value (B−A) was equal to 1 or 0 (and for 93.24% of the frames, the difference value (B−A) was equal to 1, 0, or −1).

We have recognized (consistent with FIG. 7) that when an embodiment of the inventive E-AC-3 encoder is to generate an E-AC-3 encoded bitstream with a first target data rate of 640 Kbps, and to generate a second control parameter (converter SNR offset parameter) for inclusion in the E-AC-3 bitstream for use by a converter (to generate an AC-3 bitstream having a second target data rate of 640 Kbps) in response to the E-AC-3 bitstream, the encoder is desirably configured to generate the second control parameter (for each frame of the E-AC-3 bitstream) as follows: a first candidate value (of the second control parameter) is determined to be equal to the first control parameter for the frame (which may be denoted as "A"), and then K iterations (where K=1 or K=2) iterations (of a bit allocation process) are performed to generate to generate K additional candidate values (of the second control parameter). In the first iteration, the candidate value of the second control parameter is set equal to A−1. In the second iteration (if it is performed), the candidate value of the second control parameter is set equal to A−2. A best one of the K+1 candidate values is identified as the one which will control the converter to use the largest number of bits to perform AC-3 encoding of the audio content of the frame without exceeding the total number of available bits for performing AC-3 encoding of the frame's audio content. The candidate value which is so identified as the best one is included in the E-AC-3 bitstream (as the second control parameter for the frame) by the E-AC-3 encoder. Where K=2, this three-step process (an initial bit allocation determination step followed by two bit allocation determination steps on incremented versions of the initial candidate second control parameter) is expected to determine the correct second control parameter for each frame with a confidence of 99.04% (as indicated by the fourth row of the third column of FIG. 7), or in other words is expected to correctly determine the second control parameter for 99.04% of all the frames.

If it is desired to determine a useful (e.g., correct) second control parameter for each frame with a confidence of greater than 99.04%, more than two (as indicated by the fourth row of the third column of FIG. 7), a "K+1" step iterative bit allocation process (comprising an initial bit allocation determination step followed by K bit allocation determination steps on incremented versions of the initial candidate second control parameter, where K is greater than 2) can be performed to determine the second control parameter for each frame with the desired degree of confidence (e.g., a confidence of 99.63%, where K=3, as indicated by the fifth row of the third column of FIG. 7).

Figure 9:
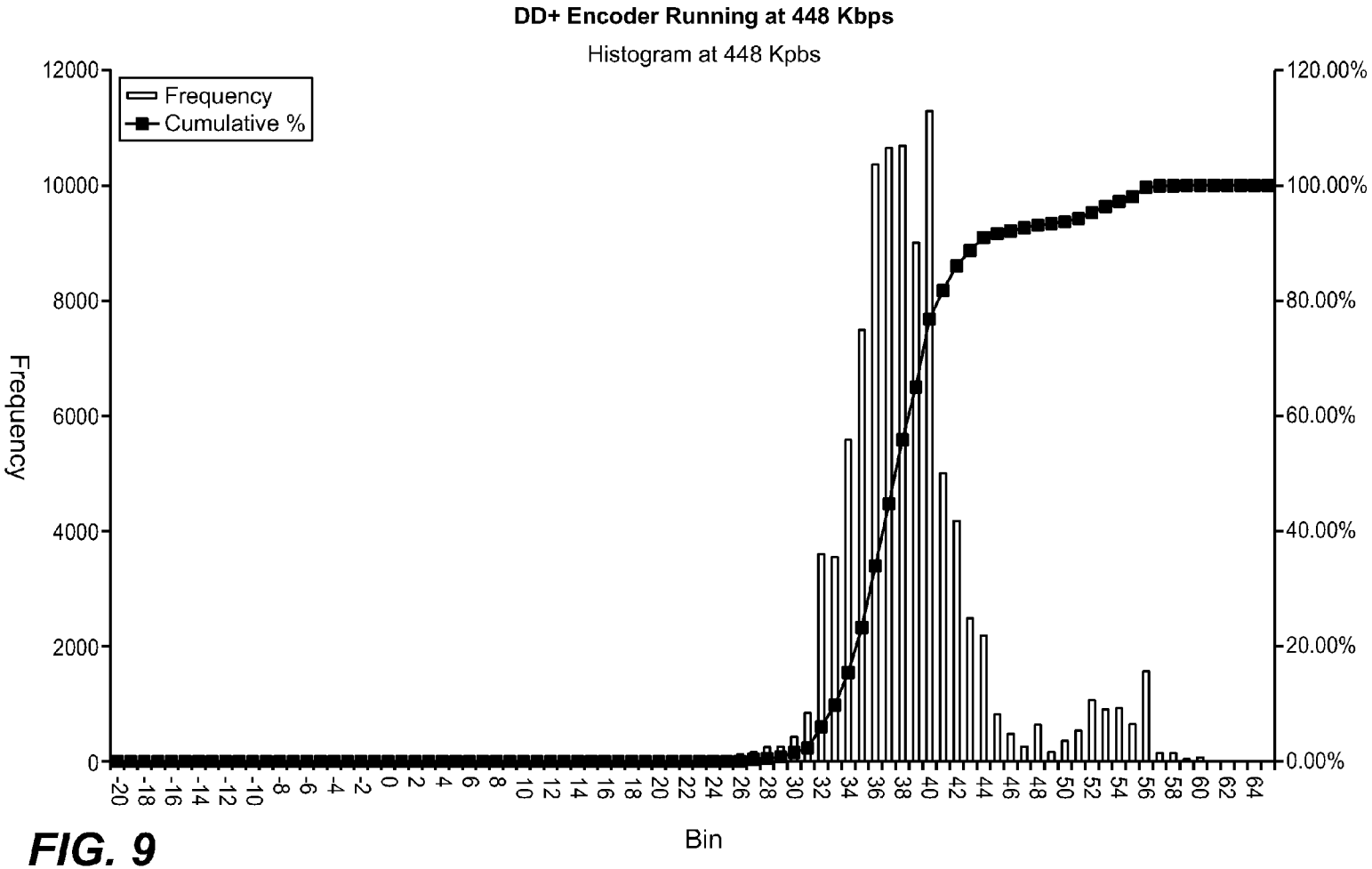
FIG. 9 is a histogram and a graph of the data shown in FIG. 8.

With reference to FIGS. 8 and 9, we next describe another embodiment in the second class in which an E-AC-3 encoder (an implementation of DD+ encoder 300) is configured to operate at a first target data rate of 448 Kbps to generate the second control parameter (the converter SNR offset parameter), and the second target data rate is equal to 640 Kbps. FIG. 8 is a table of data generated by analyzing results of operation of the encoder (running at 448 Kbps) to encode the same sequence of N frames of audio data employed to generate the FIG. 7 data. Thus, for each of the frames (i.e., for the "i"th frame, where i is an index in a range from 1 through N), an iterative bit allocation process (in accordance with the E-AC-3 codec system) is performed (in bit allocation unit 305) to determine an SNR offset value (the first control parameter) for the frame, and an iterative bit allocation process (in accordance with the AC-3 codec system) is performed (in simulation unit 320) to generate a converter SNR offset parameter (the second control parameter) for the frame.

In FIG. 8, the first column (labeled "SNR offset difference") indicates values of the difference between the two determined values (B−A, where A is the first control parameter determined for a frame and B is the second control parameter determined for the same frame) for each frame, and each row of the second column (labeled "Frequency") indicates the number of frames for which the SNR offset difference (the difference value, B−A) is as indicated in the corresponding row of the first column. For example, for 3612 of the frames the determined second control parameter was greater by 32 than the determined first control parameter (B−A=32). Similarly, for 2198 of the frames the determined second control parameter was greater by 44 than the determined first control parameter (B−A=44).

Each row of the third column in FIG. 8 (labeled "Cumulative %") indicates the cumulative percentage of the frames for which the difference value (B−A) was less than or equal to the difference value (B−A) in the same row of the first column. For example, for 0.99% of the frames, the difference value (B−A) was less than or equal to 29 (and for 99.52% of the frames, the difference value (B−A) was less than or equal to 56).

FIG. 9 is a histogram and a graph of the data shown in FIG. 8, with "Bin" values indicated along the horizontal axis of FIG. 9 corresponding to the values in the first column of FIG. 8, the "Frequency" values indicated along the vertical axis at the left side of FIG. 9 corresponding to the values in the second column of FIG. 8, and the "Cumulative %" values indicated along the vertical axis at the right side of FIG. 9 corresponding to the values in the third column of FIG. 9.

We have recognized (consistent with FIG. 8) that when an embodiment of the inventive E-AC-3 encoder is to generate an E-AC-3 encoded bitstream with a first target data rate of 448 Kbps, and to generate a second control parameter (converter SNR offset parameter) for inclusion in the E-AC-3 bitstream for use by a converter (to generate an AC-3 bitstream having a second target data rate of 640 Kbps) in response to the E-AC-3 bitstream, the encoder is desirably configured to generate the second control parameter (for each frame of the E-AC-3 bitstream) as follows: a first candidate value (of the second control parameter) is determined to be a value in the range from A+30 through A+56, where "A" is the first control parameter for the frame, and K iterations (of a bit allocation process) are performed to generate to generate K candidate values (of the second control parameter). In the first iteration, the candidate value of the second control parameter is set equal to a first value in the range from A+30 through A+56. In the second iteration, the candidate value of the second control parameter is set equal to some other value in the range from A+30 through A+56, and so on (with the candidate values of the second control parameter in the "M"th iteration set to be equal to some value in the range from A+30 through A+56). The best of the K candidate values is identified as the one which will control the converter to use the largest number of bits to perform AC-3 encoding of the audio content of the frame without exceeding the total number of available bits for performing AC-3 encoding of the frame's audio content. The candidate value which is so identified as the best one is included in the E-AC-3 bitstream (as the second control parameter for the frame) by the E-AC-3 encoder. This "K"-step process (an initial bit allocation determination step followed by K−1 allocation determination steps on incremented versions of the initial candidate second control parameter) is expected to determine the correct second control parameter for each frame with a confidence of 98.53% (as indicated by the difference between the values in the rows of the third column of FIG. 8 corresponding to SNR offset differences of 29 and 56), or in other words is expected to correctly determine the second control parameter for 98.53% of all the frames. It is apparent that the maximum number of iterations required to determine the second control parameter with this confidence is K=27. However, by implementing the iterative bit allocation process as a binary search, the required number of iterations to determine the second control parameter for each frame with a confidence of 98.53% is 6 iterations (i.e., $(\log_2(27)+1)$, rounded up to the nearest integer).

If it is desired to determine the correct second control parameter for each frame with a confidence of less than 98.53%, assuming a first target data rate of 448 Kbps, an "M" iteration process (where M is less than K, where K is as defined in the previous paragraph) can be performed as follows: In the first iteration, the candidate value of the second control parameter is set equal to a first value in the range from A+D through A+C, where "A" is the first control parameter for the frame, "D" is greater than or equal to 30, and "C" is less than or equal to 56. In the second iteration, the candidate value of the second control parameter is set equal to some other value in the range from A+D through A+C, and so on (with the candidate values of the second control parameter in each iteration set to be equal to some value in the range from A+D through A+C). The best of the M candidate values is identified as the one which will control the converter to use the largest number of bits to perform AC-3 encoding of the audio content of the frame without exceeding the total number of available bits for performing AC-3 encoding of the frame's audio content. The candidate value which is so identified as the best one is included in the E-AC-3 bitstream (as the second control parameter for the frame) by the E-AC-3 encoder. For example, if C=32 and D=44, by implementing the iterative bit allocation process as a binary search, the required number of iterations to determine the second control parameter for each frame with a confidence of 81.05% is 5 iterations (i.e., $(\log_2(13)+1)$, rounded up to the nearest integer).

Figure 10:
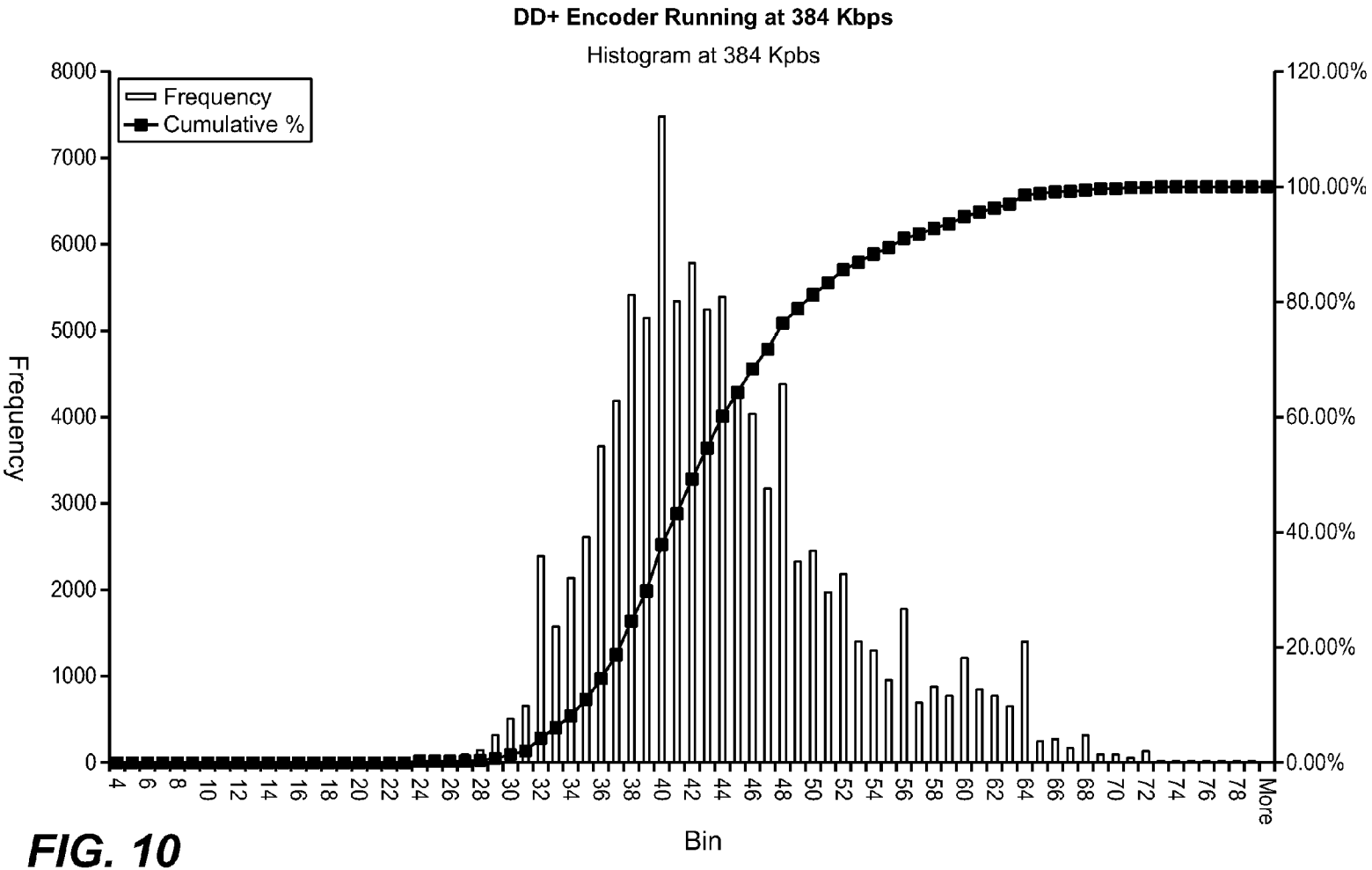
FIG. 10 is a histogram and a graph of data generated by analyzing results of operation of the DD+ encoder (running at 384 Kbps) to encode the same frames of audio data.

With reference to FIG. 10, we next describe another embodiment in the second class in which an E-AC-3 encoder (an implementation of DD+ encoder 300) is configured to operate at a first target data rate of 384 Kbps to generate the second control parameter (the converter SNR offset parameter), and the second target data rate is equal to 640 Kbps. FIG. 10 is a histogram and graph of data generated by analyzing results of operation of the encoder (running at 384 Kbps) to encode the same sequence of N frames of audio data employed to generate the FIG. 7 data. Thus, for each of the frames (i.e., for the "i"th frame, where i is an index in a range from 1 through N), an iterative bit allocation process (in accordance with the E-AC-3 codec system) is performed (in bit allocation unit 305) to determine an SNR offset value (the first control parameter) for the frame, and an iterative bit allocation process (in accordance with the AC-3 codec system) is performed (in simulation unit 320) to generate a converter SNR offset parameter (the second control parameter) for the frame.

The "Bin" values indicated along the horizontal axis of FIG. 10 are values of the SNR offset difference between the two control parameter values determined for each frame (i.e., each Bin value is a value "B−A," where A is the first control parameter determined for a frame and B is the second control parameter determined for the same frame).

The "Frequency" values indicated along the vertical axis at the left side of FIG. 10 indicate the number of frames for which the SNR offset difference (the difference value, B−A) is as indicated in the histogram shown in FIG. 10. For example, about 7400 of the frames have a "Bin" value equal to 40 (B−A=40), which indicates that for each of these frames the determined second control parameter ("B") was greater by 40 than the determined first control parameter ("A").

The curve indicate in FIG. 10 is a graph of the "Cumulative %" values indicated along the vertical axis at the right side of FIG. 10 as a function of the "Bin" values indicated along the horizontal axis. Each "Cumulative %" value indicates the cumulative percentage of the total number of frames for which the difference value, B−A, was less than or equal to the corresponding "Bin" value. For example, the "Cumulative %" value for Bin=40 is about 37%, which indicates that for about 37% of the frames, the difference value (B−A) was less than or equal to 40.

Figure 12:
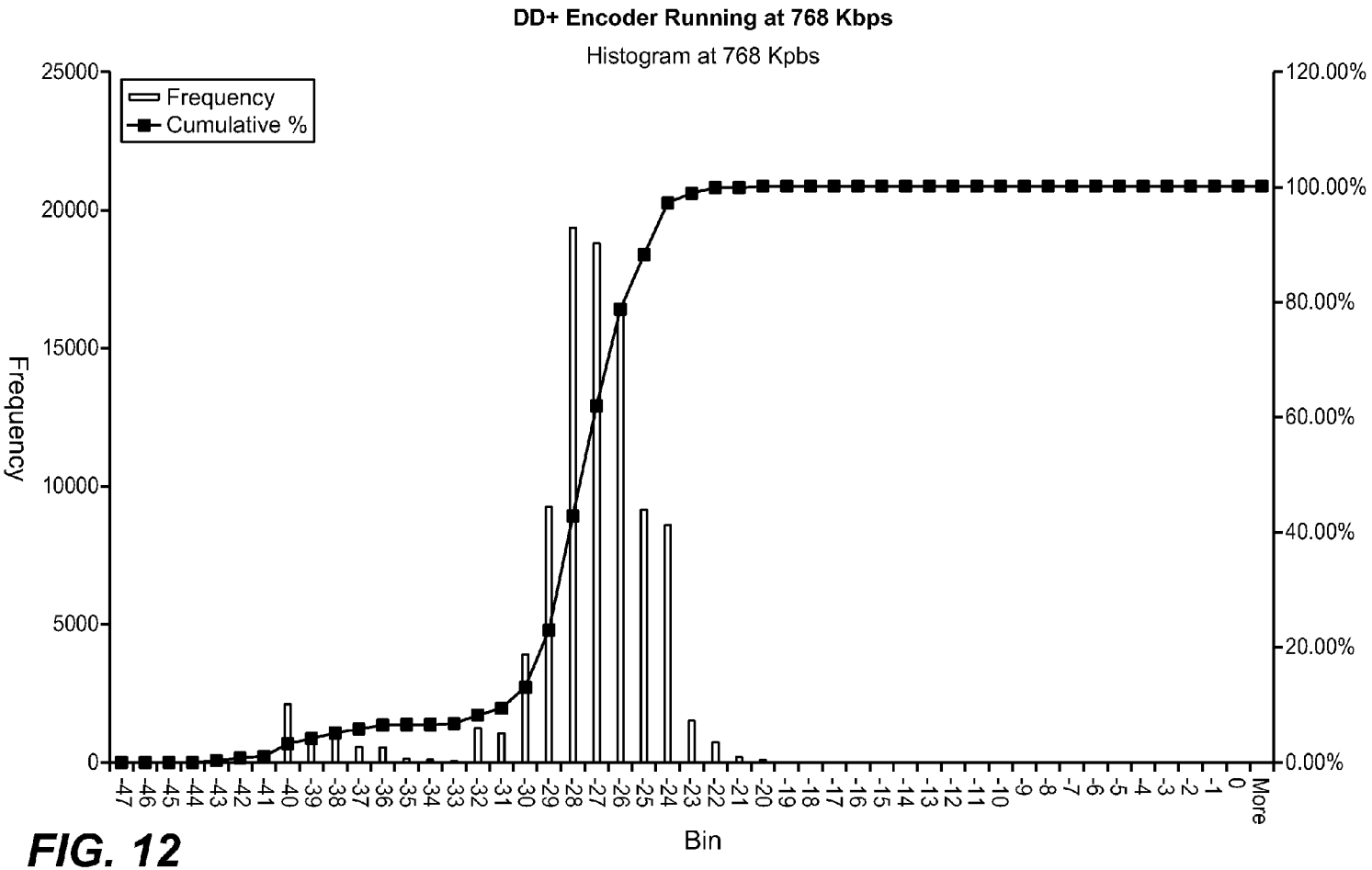
FIG. 12 is a histogram and a graph of the data shown in FIG. 11.

With reference to FIGS. 11 and 12, we next describe another embodiment in the second class in which an E-AC-3 encoder (an implementation of DD+ encoder 300) is configured to operate at a first target data rate of 768 Kbps to generate the second control parameter (the converter SNR offset parameter), and the second target data rate is equal to 640 Kbps. FIG. 11 is a table of data generated by analyzing results of operation of the encoder (running at 768 Kbps) to encode the same sequence of N frames of audio data employed to generate the FIG. 7 data. Thus, for each of the frames (i.e., for the "i"th frame, where i is an index in a range from 1 through N), an iterative bit allocation process (in accordance with the E-AC-3 codec system) is performed (in bit allocation unit 305) to determine an SNR offset value (the first control parameter) for the frame, and an iterative bit allocation process (in accordance with the AC-3 codec system) is performed (in simulation unit 320) to generate a converter SNR offset parameter (the second control parameter) for the frame.

In FIG. 11, the first column (labeled "SNR offset difference") indicates values of the difference between the two determined values (B−A, where A is the first control parameter determined for a frame and B is the second control parameter determined for the same frame) for each frame, and each row of the second column (labeled "Frequency") indicates the number of frames for which the SNR offset difference (the difference value, B−A) is as indicated in the corresponding row of the first column. For example, for 426 of the frames the determined second control parameter was less by 41 than the determined first control parameter (B−A=−41). Similarly, for 1551 of the frames the determined second control parameter was less by 23 than the determined first control parameter (B−A=−23).

Each row of the third column in FIG. 11 (labeled "Cumulative %") indicates the cumulative percentage of the frames for which the difference value (B−A) was less than or equal to the difference value (B−A) in the same row of the first column. For example, for 5.16% of the frames, the difference value (B−A) was less than or equal to −38.

FIG. 12 is a histogram and a graph of the data shown in FIG. 11, with "Bin" values indicated along the horizontal axis of FIG. 12 corresponding to the values in the first column of FIG. 11, the "Frequency" values indicated along the vertical axis at the left side of FIG. 12 corresponding to the values in the second column of FIG. 11, and the "Cumulative %" values indicated along the vertical axis at the right side of FIG. 12 corresponding to the values in the third column of FIG. 11.

We have recognized (consistent with FIG. 11) that when an embodiment of the inventive E-AC-3 encoder is to generate an E-AC-3 encoded bitstream with a first target data rate of 768 Kbps, and to generate a second control parameter (converter SNR offset parameter) for inclusion in the E-AC-3 bitstream for use by a converter (to generate an AC-3 bitstream having a second target data rate of 640 Kbps) in response to the E-AC-3 bitstream, the encoder is desirably configured to generate the second control parameter (for each frame of the E-AC-3 bitstream) as follows: a first candidate value (of the second control parameter) is determined to be a value in the range from A−37 through A−22, where "A" is the first control parameter for the frame, and K iterations (of a bit allocation process) are performed to generate to generate K candidate values (of the second control parameter). In the first iteration, the candidate value of the second control parameter is set equal to a first value in the range from A−37 through A−22. In the second iteration, the candidate value of the second control parameter is set equal to some other value in the range from A−37 through A−22, and so on (with the candidate values of the second control parameter in the "M"th iteration set to be equal to one of the sixteen values in the range from A−37 through A−22). The best of the K candidate values is identified as the one which will control the converter to use the largest number of bits to perform AC-3 encoding of the audio content of the frame without exceeding the total number of available bits for performing AC-3 encoding of the frame's audio content. The candidate value which is so identified as the best one is included in the E-AC-3 bitstream (as the second control parameter for the frame) by the E-AC-3 encoder. This "K"-step process (an initial bit allocation determination step followed by K−1 allocation determination steps on incremented versions of the initial candidate second control parameter) is expected to determine the correct second control parameter for each frame with a confidence of 94.44% (as indicated by the difference between the values in the rows of the third column of FIG. 11 corresponding to SNR offset differences of −22 and −38), or in other words is expected to correctly determine the second control parameter for 94.44% of all the frames. It is apparent that the maximum number of iterations required to determine the second control parameter with this confidence is K=16. However, by implementing the iterative bit allocation process as a binary search, the required number of iterations to determine the second control parameter for each frame with a confidence of 94.44% is 5 iterations (i.e., $(\log_2(16)+1)$.

Another embodiment is a converter (e.g., a transcoder) configured to perform transcoding on an encoded audio bitstream including a second control parameter generated in accordance with any embodiment of the invention. For example, the second control parameter may be a "converter snroffset" parameter (generated by an E-AC-3 encoder which is an embodiment in the above-described second class of embodiments of the invention) and the converter may be a transcoder (an E-AC-3 format to AC-3 format transcoder) configured to decode the encoded audio bitstream (which has E-AC-3 format in this example) and to generate a second encoded bitstream (having AC-3 format) in response to the encoded audio bitstream using the "converter snroffset" parameter.

Other embodiments of the invention are encoding and transcoding methods performed by any embodiment of the inventive encoder or converter.

The methods and systems described in the present document may be implemented as software, firmware and/or hardware. Certain components may e.g. be implemented as software running on a digital signal processor or microprocessor. Other components may e.g. be implemented as hardware and or as application specific integrated circuits. The signals encountered in the described methods and systems may be stored on media such as random access memory or optical storage media. They may be transferred via networks, such as radio networks, satellite networks, wireless networks or wireline networks, e.g., the Internet. Typical devices making use of the methods and systems described in the present document are portable electronic devices or other consumer equipment which are used to store and/or render audio signals.

What is claimed is:

1. An audio encoder configured to encode at least one frame of an audio signal at a first target data rate in accordance with an E-AC-3 codec system, thereby generating a bitstream indicative of encoded audio content including quantized mantissas, said encoder comprising:

a transform subsystem coupled and configured to determine spectral coefficients indicative of audio content of the frame of the audio signal;

a floating-point encoding subsystem configured to determine mantissas and encoded exponents based on the spectral coefficients;

a bit allocation and quantization subsystem configured to determine a first control parameter indicative of an allocation of available bits for quantizing the mantissas in accordance with the E-AC-3 codec system, and to quantize the mantissas in accordance with the first control parameter to determine the quantized mantissas;

a bitstream packing subsystem coupled and configured to generate the bitstream at the first target data rate such that said bitstream is indicative of a second control parameter and encoded audio content of the frame, said encoded audio content including the quantized mantissas; and a transcoding simulation subsystem configured to simulate transcoding, said transcoding including decoding of the encoded audio content of the frame to generate decoded data including de-quantized mantissas and re-encoding of the decoded data at a second target data rate in accordance with an AC-3 codec system to generate a second bitstream indicative of re-encoded audio content including re-quantized mantissas, wherein the transcoding simulation subsystem is configured to execute an iterative bit allocation process to determine the second control parameter such that said second control parameter is indicative of an allocation of available bits for quantizing the de-quantized mantissas to generate said re-quantized mantissas during generation of the second bitstream in accordance with the AC-3 codec system at the second target data rate, wherein each bit allocation iteration of the iterative bit allocation process assumes a candidate allocation of available bits determined by a different candidate second control parameter of a set of candidate second control parameters, the set of candidate second control parameters having been predetermined by statistical analysis of results of bit allocation processing of audio data in accordance with the E-AC-3 codec system assuming the first target data rate, and results of bit allocation processing of the audio data in accordance with the AC-3 codec system assuming the second target data rate.

2. The audio encoder of claim 1, wherein the first control parameter is an SNR offset parameter, and the second control parameter is a converter SNR offset parameter.

3. The audio encoder of claim 1, wherein the second target data rate is at least substantially equal to the first target data rate, the set of candidate second control parameters includes the first control parameter, and one bit allocation iteration of the iterative bit allocation process assumes a candidate allocation of available bits determined by the first control parameter.

4. The audio encoder of claim 3, wherein the iterative bit allocation process includes no more than N bit allocation iterations, where N is less than or equal to three.

5. The audio encoder of claim 3, wherein the iterative bit allocation process includes no more than a predetermined number of bit allocation iterations, said number of bit allocation iterations having been predetermined as a result of the statistical analysis to be the minimum number of iterations expected to be necessary to determine a final value of the second control parameter with a predetermined degree of confidence.

6. The audio encoder of claim 1, wherein the second target data rate is equal to R, the first target data rate is not equal to R, and the iterative bit allocation process includes no more than a predetermined number of bit allocation iterations, said number of bit allocation iterations having been predetermined as a result of the statistical analysis to be the minimum number of iterations expected to be necessary to determine a final value of the second control parameter with a predetermined degree of confidence.

7. The audio encoder of claim 6, wherein R is at least substantially equal to 640 Kbps.

8. The audio encoder of claim 6, wherein the iterative bit allocation process is implemented as a binary search.

9. The audio encoder of claim 1, wherein the transcoding simulation subsystem is coupled and configured to de-quantize the quantized mantissas using the first control parameter to generate the de-quantized mantissas, and to re-quantize the de-quantized mantissas in accordance with each said candidate allocation of available bits to generate a candidate set of the re-quantized mantissas.

10. The audio encoder of claim 1, wherein the transcoding simulation subsystem is coupled and configured to:

determine a power spectral density distribution and a masking curve based on the encoded exponents;

determine an offset masking curve by offsetting the masking curve in accordance with each said candidate allocation of available bits; and determine a number of required bits for quantizing the de-quantized mantissas, based on comparison of the power spectral density distribution and the offset masking curve.

11. An audio transcoder, including:

a memory which stores encoded audio content and data indicative of a second control parameter, said encoded audio content including quantized mantissas; and a transcoding subsystem coupled to the memory and configured to perform transcoding on the encoded audio content at a second target data rate, in accordance with an AC-3 codec system and using the second control parameter, thereby generating a bitstream indicative of re-encoded audio content including re-quantized mantissas, wherein the second control parameter and the encoded audio content have been determined during encoding of a frame of an audio signal, at a first target data rate in accordance with an E-AC-3 codec system, including by:

determining spectral coefficients indicative of audio content of a frame of the audio signal, determining mantissas and encoded exponents based on the spectral coefficients, determining a first control parameter indicative of an allocation of available bits for quantizing the mantissas in accordance with the E-AC-3 codec system, quantizing the mantissas in accordance with the first control parameter to determine the quantized mantissas, and in a transcoding simulation subsystem configured to simulate transcoding, executing an iterative bit allocation process to determine the second control parameter, said transcoding including generation of decoded data including de-quantized mantissas by decoding encoded content which has been generated by encoding audio content at the first target data rate in accordance with the E-AC-3 codec system, said transcoding also including re-encoding of the decoded data at the second target data rate in accordance with the AC-3 codec system to determine re-encoded content including re-quantized mantissas, such that the second control parameter is indicative of an allocation of available bits for quantizing the de-quantized mantissas to generate said re-quantized mantissas, wherein each bit allocation iteration of the iterative bit allocation process assumes a candidate allocation of available bits determined by a different candidate second control parameter of a set of candidate second control parameters, the set of candidate second control parameters having been predetermined by statistical analysis of results of bit allocation processing of audio data in accordance with the E-AC-3 codec system assuming the first target data rate, and results of bit allocation processing of the audio data in accordance with the AC-3 codec system assuming the second target data rate.

12. The audio transcoder of claim 11, wherein the first control parameter is an SNR offset parameter, and the second control parameter is a converter SNR offset parameter.

13. The audio transcoder of claim 11, wherein the second target data rate is at least substantially equal to the first target data rate, the set of candidate second control parameters includes the first control parameter, and one bit allocation iteration of the iterative bit allocation process assumes a candidate allocation of available bits determined by the first control parameter.

14. The audio transcoder of claim 13, wherein the iterative bit allocation process includes no more than N bit allocation iterations, where N is less than or equal to three.

15. The audio transcoder of claim 13, wherein the iterative bit allocation process includes no more than a predetermined number of bit allocation iterations, said number of bit allocation iterations having been predetermined as a result of the statistical analysis to be the minimum number of iterations expected to be necessary to determine a final value of the second control parameter with a predetermined degree of confidence.

16. The audio transcoder of claim 11, wherein the second target data rate is equal to R, the first target data rate is not equal to R, and the iterative bit allocation process includes no more than a predetermined number of bit allocation iterations, said number of bit allocation iterations having been predetermined as a result of the statistical analysis to be the minimum number of iterations expected to be necessary to determine a final value of the second control parameter with a predetermined degree of confidence.

17. The audio transcoder of claim 16, wherein R is at least substantially equal to 640 Kbps.

18. The audio transcoder of claim 16, wherein the iterative bit allocation process is implemented as a binary search.

19. The audio transcoder of claim 11, wherein said transcoder is coupled and configured to receive an encoded audio signal, to extract from the encoded audio signal the encoded audio content and the data indicative of the second control parameter, and to buffer said data and said encoded audio content in the memory.

20. The audio transcoder of claim 19, wherein the transcoder is configured to extract from the encoded audio signal additional data indicative of the first control parameter, and to buffer said additional data in the memory, and wherein the transcoding subsystem is configured to use said additional data to perform said transcoding on the encoded audio content.

21. A method for encoding at least one frame of an audio signal at a first target data rate in accordance with an E-AC-3 codec system, said method including steps of:

determining spectral coefficients indicative of audio content of the frame of the audio signal;

determining mantissas and encoded exponents based on the spectral coefficients;

determining a first control parameter indicative of an allocation of available bits for quantizing the mantissas in accordance with the E-AC-3 codec system;

quantizing the mantissas in accordance with the first control parameter to determine the quantized mantissas;

generating a bitstream at the first target data rate such that said bitstream is indicative of a second control parameter and encoded audio content of the frame, said encoded audio content including the quantized mantissas; and executing an iterative bit allocation process to determine the second control parameter, including by simulating transcoding including generation of decoded data including de-quantized mantissas by decoding the encoded audio content of the frame, said transcoding also including re-encoding of the decoded data at a second target data rate in accordance with an AC-3 codec system to determine re-encoded content including re-quantized mantissas, such that the second control parameter is indicative of an allocation of available bits for quantizing the de-quantized mantissas to generate said re-quantized mantissas, wherein each bit allocation iteration of the iterative bit allocation process assumes a candidate allocation of available bits determined by a different candidate second control parameter of a set of candidate second control parameters, the set of candidate second control parameters having been predetermined by statistical analysis of results of bit allocation processing of audio data in accordance with the E-AC-3 codec system assuming the first target data rate, and results of bit allocation processing of the audio data in accordance with the AC-3 codec system assuming the second target data rate.

22. The method of claim 21, wherein the first control parameter is an SNR offset parameter, and the second control parameter is a converter SNR offset parameter.

23. The method of claim 21, wherein the second target data rate is at least substantially equal to the first target data rate, the set of candidate second control parameters includes the first control parameter, and one bit allocation iteration of the iterative bit allocation process assumes a candidate allocation of available bits determined by the first control parameter.

24. The method of claim 23, wherein the iterative bit allocation process includes no more than N bit allocation iterations, where N is less than or equal to three.

25. The method of claim 23, wherein the iterative bit allocation process includes no more than a predetermined number of bit allocation iterations, said number of bit allocation iterations having been predetermined as a result of the statistical analysis to be the minimum number of iterations expected to be necessary to determine a final value of the second control parameter with a predetermined degree of confidence.

26. The method of claim 21, wherein the second target data rate is equal to R, the first target data rate is not equal to R, and the iterative bit allocation process includes no more than a predetermined number of bit allocation iterations, said number of bit allocation iterations having been predetermined as a result of the statistical analysis to be the minimum number of iterations expected to be necessary to determine a final value of the second control parameter with a predetermined degree of confidence.

27. The method of claim 26, wherein the iterative bit allocation process is implemented as a binary search.

* * * * *